US008801268B2

(12) United States Patent
Uchiyama et al.

(10) Patent No.: US 8,801,268 B2
(45) Date of Patent: Aug. 12, 2014

(54) DETENT ESCAPEMENT FOR TIMEPIECE AND MECHANICAL TIMEPIECE

(75) Inventors: Hiroki Uchiyama, Chiba (JP); Matsuo Kishi, Chiba (JP); Takashi Niwa, Chiba (JP); Masayuki Koda, Chiba (JP); Miei Sato, Chiba (JP)

(73) Assignee: Seiko Instruments Inc. (JP)

( * ) Notice: Subject to any disclaimer, the term of this patent is extended or adjusted under 35 U.S.C. 154(b) by 384 days.

(21) Appl. No.: 13/199,953

(22) Filed: Sep. 13, 2011

(65) Prior Publication Data

US 2012/0063274 A1 Mar. 15, 2012

(30) Foreign Application Priority Data

Sep. 14, 2010 (JP) ..... 2010-205289
Jul. 5, 2011 (JP) ..... 2011-149062

(51) Int. Cl.
*G04B 15/00* (2006.01)
*G04B 15/06* (2006.01)

(52) U.S. Cl.
CPC ..... *G04B 15/06* (2013.01)
USPC ..... 368/127; 368/131

(58) Field of Classification Search
CPC ..... G04B 15/06
USPC ..... 368/124, 127, 129–131
See application file for complete search history.

(56) References Cited

U.S. PATENT DOCUMENTS

| | | | | |
|---|---|---|---|---|
| 48,726 | A * | 7/1865 | Rothfelder | 368/131 |
| 7,686,503 | B2 * | 3/2010 | Rochat et al. | 368/127 |
| 2005/0128880 | A1 | 6/2005 | Hayek et al. | 368/124 |
| 2008/0219103 | A1 * | 9/2008 | Baumberger et al. | 368/131 |
| 2010/0149926 | A1 | 6/2010 | Colpo et al. | 368/127 |
| 2010/0214881 | A1 * | 8/2010 | Chiuve et al. | 368/131 |
| 2012/0218870 | A1 * | 8/2012 | Koda et al. | 368/131 |

FOREIGN PATENT DOCUMENTS

| | | |
|---|---|---|
| JP | 2010 181223 | 8/2010 |
| JP | 2011 059079 | 3/2011 |
| JP | 2011 059081 | 3/2011 |

* cited by examiner

*Primary Examiner* — Vit W Miska
(74) *Attorney, Agent, or Firm* — Adams & Wilks

(57) ABSTRACT

A detent escapement for a mechanical timepiece includes an escape wheel, a balance mounted for undergoing oscillation movement about a balance staff, a blade and an actuating spring. The balance has an unlocking stone and has an impulse jewel for contacting a wheel tooth of the escape wheel. The blade has a locking stone for contacting the wheel tooth of the escape wheel and is supported for undergoing movement in approaching and separating directions relative to the escape wheel. The actuating spring is configured to contact the unlocking stone and is mounted for undergoing elastic deformation along the approaching and separating directions with respect to the blade. An adjustment mechanism adjusts a projecting amount of a spring tip portion of the actuating spring from a blade tip portion of the blade.

20 Claims, 16 Drawing Sheets

DETENT ESCAPEMENT FOR TIMEPIECE AND MECHANICAL TIMEPIECE

BACKGROUND OF THE INVENTION

1. Field of the Invention

The present invention relates to a detent escapement for a timepiece and a mechanical timepiece using the same.

2. Description of the Related Art

In the related art, a detent escapement is known as an escapement for daily rate of a mechanical timepiece. These kinds of escapement mechanisms are generally classified into a spring detent escapement and a pivoted detent escapement (for example, refer to JP-A-2010-181223, JP-T-2009-510425, and pages 39 to 47, "The Practical Watch Escapement", Premier Print Limited, 1994 (First Edition), written by George Daniel).

Hereinafter, a basic configuration of each detent escapement will be described.

FIG. 16 is a perspective view showing an example of the spring detent escapement of the related art.

As shown in FIG. 16, the spring detent escapement 300 includes an escape wheel 301, a balance 303 that is freely oscillated about a balance staff 302 being a rotation axis, and a detent lever 304. The balance 303 includes an impulse jewel 305 that can contact a wheel tooth 301*a* of the escape wheel 301, and an unlocking stone 306 that can contact a one-side actuating spring (passing spring) 309 which is attached to the detent lever 304.

The detent lever 304 is fixed via a balance spring 307 which is installed at a base end thereof. The balance spring 307 supports the detent lever 304 so that the detent lever 304 approaches to and separates from the escape wheel 301, and biases the detent lever 304 to be returned to the original position. That is, the detent lever 304 is constituted being capable of approaching to and separating from the escape wheel 301 with the base end of the balance spring 307 as a fulcrum 304*a*.

In addition, a locking stone 308, which can contact the wheel tooth 301*a* of the escape wheel 301, is installed to the detent lever 304. Moreover, the base end of the one-side actuating spring 309 is fixed to the base end side of the detent lever 304. The one-side actuating spring 309 is formed along the longitudinal direction of the detent lever 304 so that the tip of the one-side actuating spring 309 is slightly more protruded than that of the detent lever 304. That is, the one-side actuating spring 309 is formed so as to be along a straight line which passes through the balance staff 302 of the balance 303 and the fulcrum 304*a* of the detent lever 304. In addition, the tip of the one-side actuating spring 309 comes into contact with the unlocking stone 306 of the balance 303.

According to the above-described configuration, if the unlocking stone 306 is rotated toward the direction of an arrow CCW30 (a counterclockwise direction in FIG. 16) due to the fact that the balance 303 is freely oscillated, the detent lever 304 is pressed through the one-side actuating spring 309. Thereby, the locking stone 308, which comes into contact with the wheel tooth 301*a* of the escape wheel 301, is separated from the wheel tooth 301*a*, and the engagement between the escape wheel 301 and the detent lever 304 is released. Therefore, the escape wheel 301 is rotated by one tooth.

While the escape wheel 301 is rotated by one tooth, a bias force of the balance spring 307 acts on the detent lever 304, and the detent lever 304 is returned to the original position. Therefore, the locking stone 308 comes into contact with the wheel tooth 301*a* of the escape wheel 301 again. That is, the escape wheel 301 is engaged with the detent lever 304, and the rotation of the escape wheel 301 is stopped.

On the other hand, if the unlocking stone 306 reverses due to the free oscillation of the balance 303 and is rotated toward a direction of an arrow CW30 (a clockwise direction in FIG. 16), by the unlocking stone 306, the one-side actuating spring 309 is pressed toward the direction in which the one-side actuating spring 309 is separated from the detent lever 304. At this time, the detent lever 304 comes to be in the stopped state while the one-side actuating spring 309 is elastically deformed. After the unlocking stone 306 is separated from the one-side actuating spring 309, the one-side actuating spring 309 which is pressed to the unlocking stone 306 is returned to the original position by a restoration force of the one-side actuating spring 309 itself.

That is, when the unlocking stone 306 is rotated toward the direction of the arrow CCW30 and the detent lever 304 is pressed via the one-side actuating spring 309, the one-side actuating spring 309 does not perform any operation. On the other hand, if the unlocking stone 306 is rotated toward the direction of the arrow CW30, the one-side actuating spring 309 is elastically deformed and operated.

In addition, due the fact that the operation is repeatedly performed, a train wheel of the mechanical timepiece is driven at a constant speed.

FIG. 17 is a perspective view showing an example of the pivoted detent escapement of the related art. In addition, the same aspects as the spring detent escapement 300 of FIG. 16 are described with denoting the same reference numbers.

As shown in FIG. 17, the pivoted detent escapement 400 includes the escape wheel 301, a balance 403 which is freely oscillated about the balance staff 302, and a detent lever 404. Here, the difference between the pivoted detent escapement 400 and the spring detent escapement 300 is that the basing means for returning the detent lever to the original position are different to each other.

That is, the detent lever 404 of the pivoted detent escapement 400 is rotatably supported via the rotation axis 410, and therefore, the detent lever 404 can approach to and separate from the escape wheel 301. In addition, a balance spring 407 installed to the detent lever 404 is constituted by a coil spring so as to enclose a rotation axis 410, and biases the detent lever 404 to be returned to the original position.

In addition, in the detent lever 404, the base end of the one-side actuating spring 409 is fixed to a straight line P100 which is approximately perpendicular to the longitudinal direction of the detent lever 404 and passes through the rotation axis 410. The one-side actuating spring 409 is formed so as to be along the longitudinal direction of the detent lever 404, that is, the straight line which passes through the balance staff 302 of the balance 403 and the rotation axis 410 of the detent lever 404. The tip of the one-side actuating spring comes into contact with the unlocking stone 306 of the balance 403.

According to the configuration, due to the fact that the balance 403 is freely oscillated, if the unlocking stone 306 is rotated in the direction of an arrow CCW31 (a counterclockwise direction in FIG. 17) or in the direction of an arrow CW31 (a clockwise direction in FIG. 17), the one-side actuating spring 409 is operated or not operated at all according to the rotation. In addition, the locking stone 308 of the detent lever 404 is engaged with or separated from the wheel tooth 301*a* of the escape wheel 301. Therefore, the train wheel of the mechanical timepiece is driven at a constant speed.

However, in the above-described related art, when the one-side actuating springs 309 and 409 are operated, the unlocking stone 306 is rotated against the spring force. Therefore, energy loss with respect to the free oscillation of the balances 303 and 403 occurs. In addition, the positions of the detent levers 304 and 404 and the one-side actuating springs 309 and 409 with respect to the unlocking stone 306 influences the operation of the escape wheel 301.

That is, for example, if the contact area between the unlocking stone 306 and the one-side actuating springs 309 and 409 is small, variations toward the direction in which the one-side actuating springs 309 and 409 are separated from the escape wheel 301 are as small as the decreased contact area. Therefore, the separation movement of the locking stone s 308 and 308 of the detent levers 304 and 404 with respect to the wheel tooth 301*a* of the escape wheel 301 is difficult to normally perform, and the escape wheel 301 cannot be rotated for each tooth.

In addition, if the tip positions of the detent levers 304 and 404 are too close to the balances 303 and 403, there is a concern that the unlocking stone 306 and the detent levers 304 and 404 may come into contact with each other. In this case, free oscillation of the balances 303 and 403 are impeded by the detent levers 304 and 404, and the balances 303 and 403 cannot be normally operated. As a result, the escape wheel 301 is not normally operated.

Therefore, it is necessary to position the detent levers 304 and 404 and the one-side actuating springs 309 and 409 with respect to the unlocking stone 306 with high accuracy. Thus, the position adjustment operation of the detent levers 304 and 404 and the one-side actuating springs 309 and 409 is troublesome.

SUMMARY OF THE INVENTION

Therefore, the invention is made in consideration of the above-described problems. An object of the invention is to provide a detent escapement for a timepiece and a mechanical timepiece capable of easily performing the position adjustment operation of parts and operating reliably normally an escape wheel.

In order to accomplish the object of the invention, there is provided a detent escapement (for example, detent escapement 1) for a timepiece according to the invention including: an escape wheel (for example, escape wheel 2); a balance (for example, balance 5) that includes an impulse jewel (for example, impulse jewel 3) which can contact a wheel tooth (for example, wheel tooth 2*a*) of the escape wheel and an unlocking stone (for example, unlocking stone 4), and that freely oscillates about a balance staff (for example, balance staff 9); a blade that includes a locking stone (for example, locking stone 6) which can contact the wheel tooth of the escape wheel, and that is supported being capable of approaching to and separating from the escape wheel; a one-side actuating spring (one-side actuating spring 24) that can contact the unlocking stone and be elastically deformed along the approaching and separating direction with respect to the blade; and an adjustment mechanism in which the relative position between at least one of a blade tip portion (for example, tip portion 58) of the blade and a spring tip portion (for example, tongue 32*c*) of the one-side actuating spring and the unlocking stone can be adjusted.

In this way, due to the fact that the adjustment mechanism is provided, the positions of the blade tip portion of the blade and the spring tip portion of the one-side actuating spring can be easily adjusted with high accuracy. Therefore, the relative positions of the blade tip portion of the blade and the spring tip portion of the one-side actuating spring with respect to the unlocking stone can be determined with high accuracy. Thus, in the state where the unlocking stone, the blade, and the one-side actuating spring come to be in a desired contact state, the blade and the one-side actuating spring can be operated. Therefore, the escape wheel can be reliably normally operated.

In the detent escapement for the timepiece according to the invention, the blade may be constituted of a blade main body (for example, blade main body 51) and a blade adjustment portion (for example, blade adjustment portion 52) that is separated from the blade main body and includes at least the blade tip portion, and the blade adjustment portion may function as the adjustment mechanism.

According to the configuration, the position of the blade tip portion can be adjusted by only relatively moving the blade adjustment portion with respect to the blade main body. Thereby, the contact between the unlocking stone and the blade can be avoided while the unlocking stone can reliably contact the one-side actuating spring. Therefore, the escape wheel can be reliably normally operated.

In addition, since the configuration of the adjustment mechanism can be made simple, increase of the manufacturing cost can be suppressed.

In the detent escapement for a timepiece according to the invention, the blade main body and the blade adjustment portion may be connected via a first snap fitting mechanism (for example, first snap fitting mechanism 60).

According to the configuration, the blade main body and the blade adjustment portion, which are separated from each other, can be easily connected. In addition, the position adjustment of the blade adjustment portion with respect to the blade main body can be easily performed.

In the detent escapement for a timepiece according to the invention, the detent escapement for the timepiece may include a first position determination mechanism (for example, position determination bolt 81, position adjustment cam 85) for determining the position of the blade adjustment portion with respect to the blade main body.

According to the configuration, the position adjustment of the blade adjustment portion with respect to the blade main body can be more easily performed.

In the detent escapement for a timepiece according to the invention, the blade and the one-side actuating spring (for example, one-side actuating spring 124) may be constituted so as to be separated from each other, and at least one of the blade and the one-side actuating spring may function as the adjustment mechanism.

According to the configuration, by the simple configuration, the one-side actuating spring moves with respect to the blade or the blade moves with respect to the one-side actuating spring, and therefore, the relative position of both can be adjusted. Thereby, the unlocking stone can reliably contact the one-side actuating spring, and the contact between the unlocking stone and the blade can be avoided. Therefore, the escape wheel can be reliably normally operated, and increase of the manufacturing cost can be suppressed.

In the detent escapement for a timepiece according to the invention, the one-side actuating spring may be installed so that at least the spring tip portion slidably moves along the approaching and separating direction with respect to the balance.

According to the configuration, the unlocking stone can reliably contact the one-side actuating spring and can be more easily adjusted so that the contact between the unlocking stone and the blade is avoided.

In the detent escapement for a timepiece according to the invention, the blade and the one-side actuating spring may be connected via a second snap fitting mechanism (for example, second snap fitting mechanism 260).

According to the configuration, the blade and the one-side actuating spring, which are separated from each other, can be easily connected. In addition, the relative position between blade and the one-side actuating spring can be easily adjusted.

In the detent escapement for a timepiece according to the invention, the detent escapement for the timepiece may include a second position determination mechanism (for example, position determination bolt 181, position adjustment cam 185) for determining the position of the one-side actuating spring with respect to the blade.

According to the configuration, the relative position between the blade and the one-side actuating spring can be more easily adjusted. Thereby, the unlocking stone, the blade, and the one-side actuating spring can easily be in a desired contact state.

In the detent escapement for a timepiece according to the invention, the blade may be constituted of a blade main body (for example, blade main body 451) and a blade adjustment portion (for example, blade adjustment portion 452) that is separated from the blade main body and includes at least the blade tip portion, the blade (for example, blade 423) and the one-side actuating spring (for example, one-side actuating spring 424) may be separately constituted from each other, the blade adjustment portion and the one-side actuating spring may be integrally molded, and the blade adjustment portion and the one-side actuating spring may function as the adjustment mechanism.

According to the configuration, the position adjustment of the blade adjustment portion and the one-side actuating spring can be simultaneously performed while the relative position relationship between the blade adjustment portion and the one-side actuating spring is fixed. Thereby, while the unlocking stone can more easily and reliably contact the one-side actuating spring, the contact between the unlocking stone and the blade adjustment portion can be avoided.

In the detent escapement for a timepiece according to the invention, at least the blade tip portion of the blade adjustment portion and the spring tip portion of the one-side actuating spring may be installed so as to be slidably moved along the approaching and separating direction with respect to the balance.

According to the configuration, while the unlocking stone can reliably contact the one-side actuating spring, the unlocking stone can be more easily and reliably adjusted so that the contact between the unlocking stone and the blade is avoided.

In the detent escapement for a timepiece according to the invention, the detent escapement may include a detent fixing portion (for example, detent fixing portion 21) that can support the blade and the one-side actuating spring, a washer (for example, a fixing washer 12) that can fix the detent fixing portion to a main plate (for example, main plate 102) and can be relatively rotated with the main plate, and a rotating lever (for example, rotating lever 14) that is detachably installed to the washer, wherein the washer and the rotating lever may function as the adjustment mechanism.

According to the configuration, the positions of the blade tip portion of the blade and the spring tip portion of the one-side actuating spring can be adjusted in the rotation direction of the detent fixing portion via the detent fixing portion. Thereby, the positions of the blade tip portion of the blade and the spring tip portion of the one-side actuating spring with respect to the unlocking stone can be easily adjusted with high accuracy.

A mechanical timepiece (for example, mechanical timepiece 100) according to the invention includes: the detent escapements for the timepiece described above, a mainspring (for example, mainspring 111) that constitutes a power source, and a gear train (for example, gear train 105) that is rotated by the rotation force generated when the mainspring is rewound, wherein the rotation of the gear train is controlled by the detent escapement for the timepiece.

According to the foregoing configuration, in the mechanical timepiece according to the present invention position adjustment operation of parts can be easily performed and the escape wheel can be reliably normally operated.

According to the invention, due to the fact that the adjustment mechanism is provided, the positions of the blade tip portion of the blade and the spring tip portion of the one-side actuating spring can be easily adjusted with high accuracy. Thereby, the relative position of the blade tip portion of the blade and the spring tip portion of the one-side actuating spring with respect to the unlocking stone can be determined with high accuracy. Therefore, in the state where the unlocking stone, the blade, and the one-side actuating spring come to be in a desired contact state, the blade and the one-side actuating spring can be operated. Thus, the escape wheel can be reliably normally operated.

DETAILED DESCRIPTION OF THE PREFERRED EMBODIMENTS

First Embodiment

Mechanical Timepiece

Next, a first embodiment of the invention will be described with reference to FIGS. 1 to 8.

Figure 1:
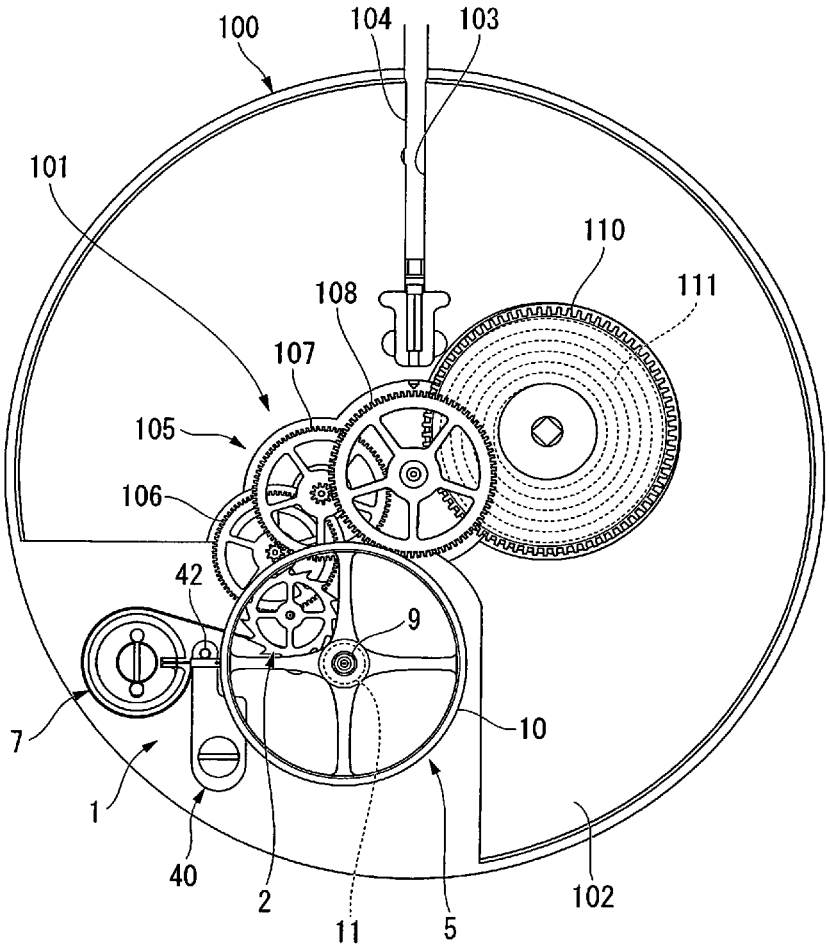
FIG. 1 is a plan view showing a movement of a mechanical timepiece according to a first embodiment of the invention from a rear cover side.

FIG. 1 is a plan view showing a movement of a mechanical timepiece from a rear cover side.

As shown in FIG. 1, the mechanical timepiece 100 includes a movement 101. The movement 101 includes a main plate 102 that constitutes a substrate of the movement 101. A winding stem guide hole 103 is formed at the main plate 102, and a winding stem 104 is rotatably assembled into the winding stem guide hole.

In addition, a switching mechanism (not shown), which includes a setting lever, a yoke, and a yoke holder, is disposed at the rear side of the movement 101 (the rear side of the paper in FIG. 1). The position in the axis direction of the winding stem 104 is determined by the switching mechanism.

On the other hand, a second wheel & pinion 106, a third wheel & pinion 107, a center wheel & pinion 108, and a movement barrel 110 constituting a gear train 105 are disposed in the front side of the movement 101 (the front side of the paper in FIG. 1). Moreover, a detent escapement 1 is disposed so as to control the rotation of the gear train 105.

The movement barrel 110 includes a mainspring 111. If the winding stem 104 is rotated, a clutch wheel (not shown) is rotated, and the mainspring 111 is wound up via a winding pinion, a crown wheel, and a ratchet wheel (none are shown). Moreover, by the rotation force which is generated when the mainspring 111 is rewound, the movement barrel 110 is rotated and the center wheel & pinion 108 is rotated.

The center wheel & pinion 108 includes a center pinion which is engaged with a movement wheel (not shown) of the movement barrel 110, and a center wheel (none are shown). If the center wheel & pinion 108 is rotated, a third wheel & pinion 107 is rotated.

The third wheel & pinion 107 includes a third pinion (not shown) which is engaged with a center wheel of the center wheel & pinion 108, and a third wheel (none are shown). If the third wheel & pinion 107 is rotated, the second wheel & pinion 106 is rotated.

The second wheel & pinion 106 includes a second pinion (not shown) which is engaged with the third wheel of the third wheel & pinion 107, and a second wheel (all is not shown). The detent escapement 1 is driven due to the fact that the second wheel & pinion 106 is rotated. Due to the fact that the detent escapement 1 is driven, the second wheel & pinion 106 is controlled to be rotated one turn in one minute, and the center wheel & pinion 108 is controlled to be rotated one turn in one hour.

(Detent Escapement)

Figure 2:
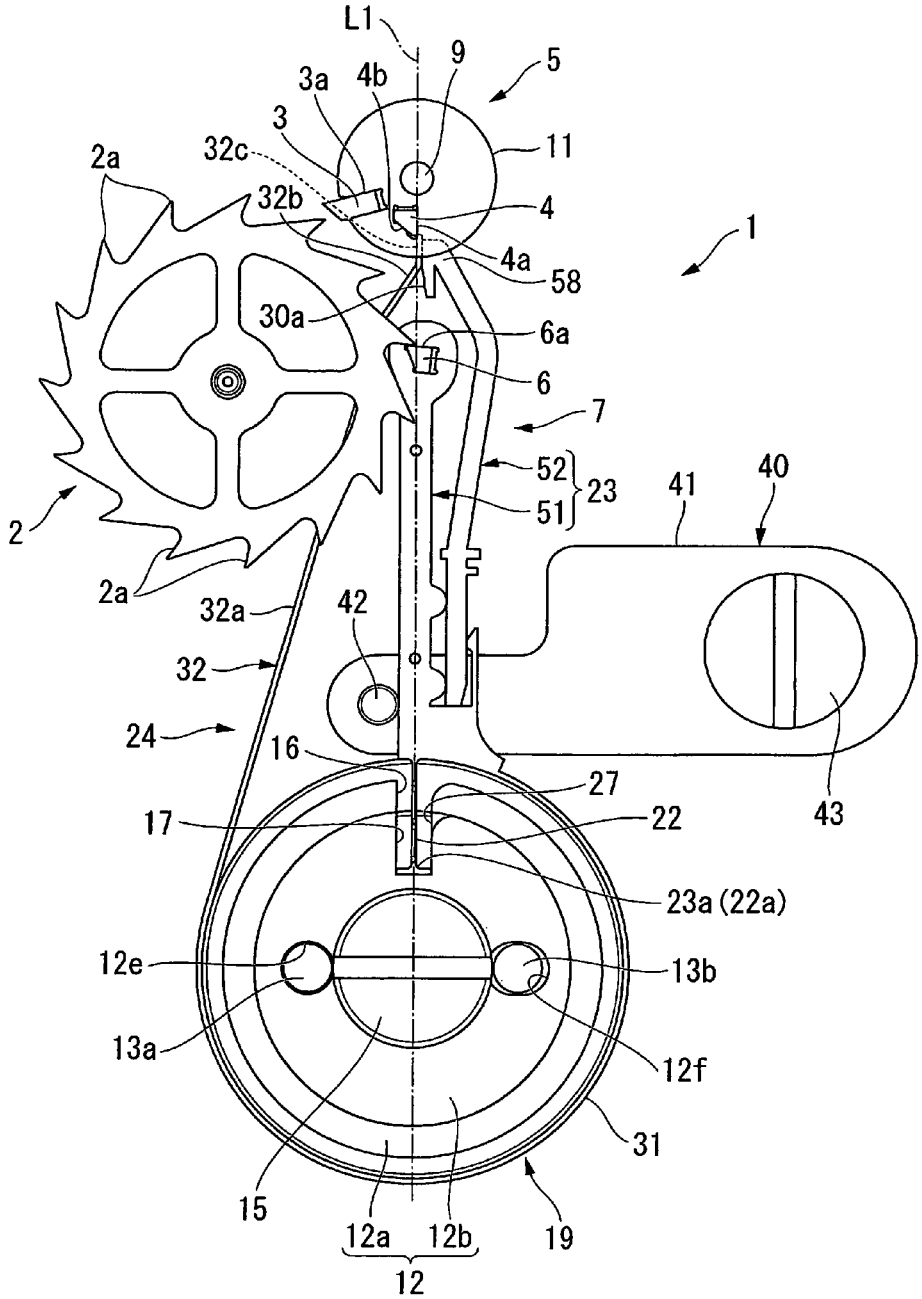
FIG. 2 is a plan view showing a detent escapement according to the first embodiment of the invention.

FIG. 2 is a plan view showing the detent escapement.

As shown in FIGS. 1 and 2, the detent escapement 1 includes: an escape wheel 2 that is rotated due to the fact that the second wheel & pinion 106 is rotated; a detent 7 including a locking stone 6 that can contact a wheel tooth 2*a* of the escape wheel 2; and a balance 5 including an impulse jewel 3 that can contact the wheel tooth 2*a* of the escape wheel 2 and an unlocking stone 4 that can contact the detent 7.

The escape wheel 2 includes an escape pinion 8 which is engaged with a second wheel (not shown), and the escape wheel is rotatably pivoted by the main plate 102 (refer to FIG. 1) and a train wheel bridge (not shown). That is, the upper axis portion of the escape pinion 8 is rotatably pivoted at the train wheel bridge, and the lower axis portion of the escape pinion 8 is rotatably pivoted at the main plate 102. In addition, the wheel tooth 2*a* of the escape wheel 2 is formed in a plurality (for example, 15 in the embodiment) at the outer periphery of the escape wheel 2.

The balance 5 is freely oscillated about a balance staff 9 which is a rotation axis. In addition, other than the balance staff 9, the balance 5 includes a balance wheel 10 which is concentrically disposed with the balance staff 9, a roller table 11 having an approximately circular plate shape, and a hairspring (not shown). Moreover, the upper axis portion of the balance staff 9 is rotatably pivoted at the balance bridge (not shown), and the lower axis portion of the balance staff 9 is rotatably pivoted at the main plate 102. Therefore, the balance 5 is rotatably pivoted at the main plate 102 and the balance bridge.

Moreover, the impulse jewel 3 and the unlocking stone 4 are installed at the large collar 11. The cross-sectional shape of the impulse jewel 3 is formed in a rectangular shape so as to be extended along the radial direction of the large collar 11. In addition, in two surfaces which face in the lateral direction of the cross-section of the impulse jewel 3, a contact surface 3*a*, which comes into contact with the wheel tooth 2*a* of the escape wheel 2, is formed so as to be more protruded from the large collar 11 than the other surface.

The unlocking stone 4 can contact a one-side actuating spring 24 described hereinafter which is installed to the detent 7. The detent 7 is fixed to the main plate 102 via an angle adjustment mechanism 19 and is operated by the unlocking stone 4.

(Angle Adjustment Mechanism)

Figure 3:
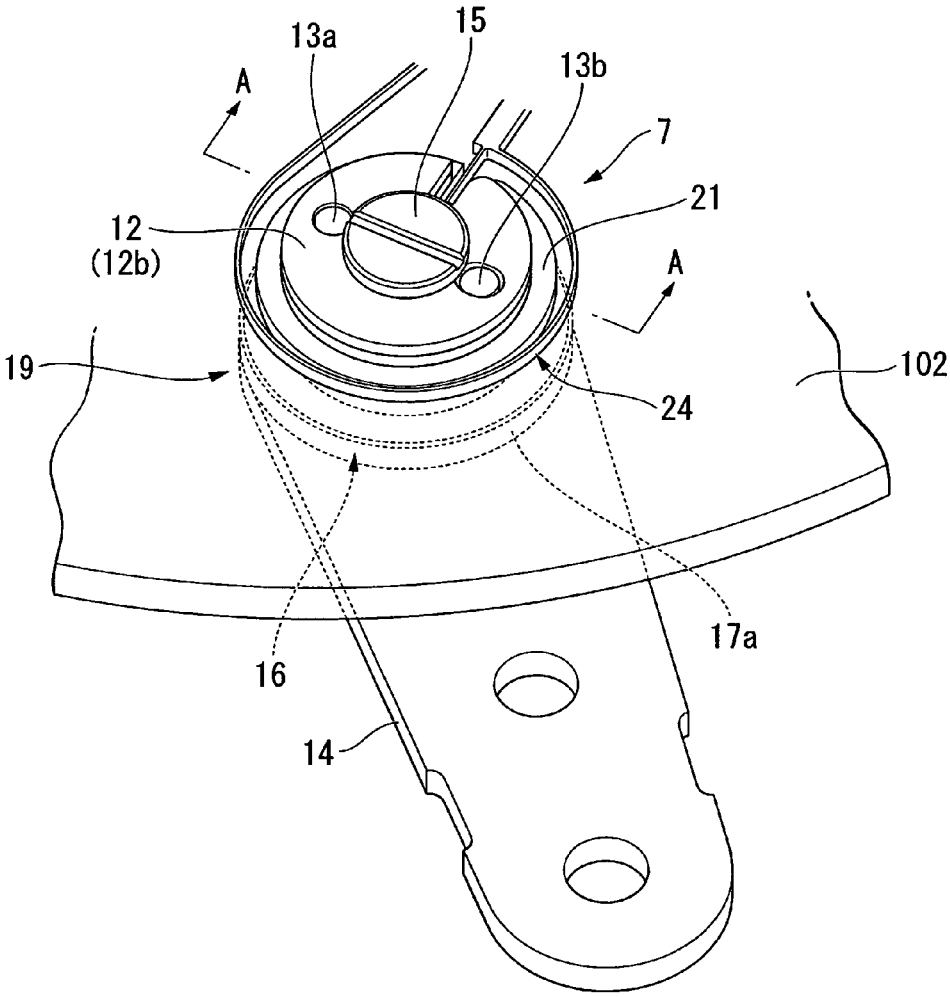
FIG. 3 is a perspective view showing an angle adjustment mechanism according to the first embodiment of the invention.
Figure 4:
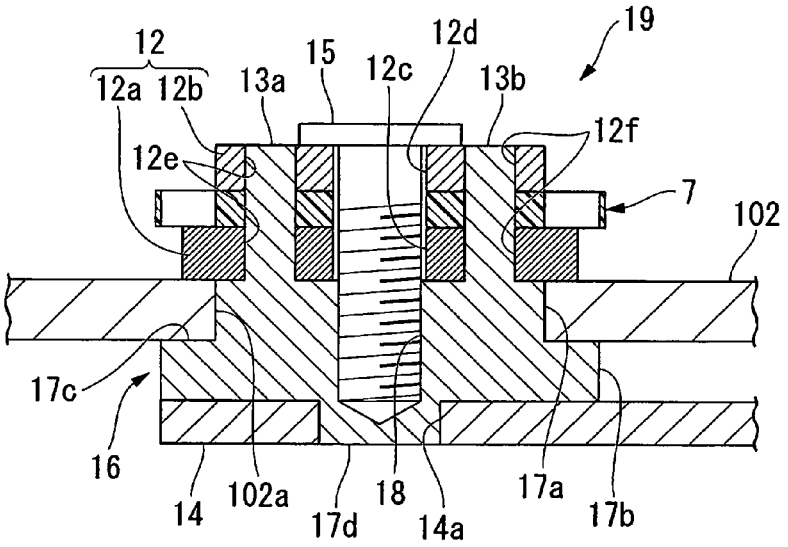
FIG. 4 is a cross-sectional view taken along a line A-A in FIG. 3

FIG. 3 is a perspective view showing the angle adjustment mechanism, and FIG. 4 is a cross-sectional view taken along a line A-A in FIG. 3.

As shown in FIGS. 3 and 4, the angle adjustment mechanism 19 adjusts the attachment angle of the detent 7. The angle adjustment mechanism 19 includes a joint portion 16 that is rotatably fitted to a penetration hole 102*a* formed in the main plate 102, a fixing washer 12 that is disposed in the front side (the front side of the paper in FIG. 3, and the upside in FIG. 4) of the main plate 102, a rotating lever 14 that is attached to the end of the rear side (the rear side of the paper in FIG. 3, and the downside in FIG. 4) of the joint portion 16, and an adjustment bolt 15 for fastening and fixing the joint portion 16 and the fixing washer 12 to the main plate 102.

The joint portion 16 is formed in a stepped columnar shape, and includes a small-diameter portion 17*a* that is fitted to the penetration hole 102*a* of the main plate 102, and a large-diameter portion 17*b* that is integrally molded at the rear side of the small-diameter portion 17*a* and diametrically more expanded by the step than the small-diameter portion 17*a*. In addition, the joint portion 16 is formed so that the front side end surface of the small-diameter portion 17*a* is flush with the main plate 102 or is in a slightly concave state with respect to the main plate 102 in a state where the front side end surface 17*c* of the large-diameter portion 17*b* abuts the main plate 102. The fixing washer 12 is disposed on the front side end surface of the small-diameter portion 17*a* which is formed as described above.

The fixing washer 12 includes a large-diameter washer 12*a* for interposing the detent 7 and a small-diameter washer 12*b*. The large-diameter washer 12*a* is disposed at the main plate 102 side. Insertion holes 12*c* and 12*d* are formed in each washer 12*a* and 12*b*, in which the adjustment bolt 15 can insert into the insertion holes at the center in the diameter direction. On the other hand, a female screw portion 18 in which the adjustment bolt 15 can be screwed into the fixing washer 12 side is formed in the center of the radial direction of the joint portion 16.

In addition, in a state where the detent 7 is interposed by each washer 12*a* and 12*b*, the adjustment bolt 15 is inserted from the front side into the joint portion 16 side, and the adjustment bolt 15 can be screwed into the joint portion 16. Thereby, the joint portion 16, the fixing washer 12, and the detent 7 are fastened together, and the main plate 102 is interposed by the large-diameter washer 12*a* of the fixing washer 12 and the large-diameter portion 17*b* of the joint portion 16.

Moreover, a convex portion 17*d* which is formed in a quadrilateral shape in plan view is protruded and installed toward the rear side in the large diameter portion 17*b* of the joint portion 16. The rotating lever 14 is attached so as to be fitted to the convex portion 17*d*. The rotating lever 14 is used when the joint portion 16 is rotated (the detail will be described hereinafter), and is formed so as to be extended from the joint portion 16 toward the outside in the radial direction. A square hole 14*a* is formed in a region corresponding to the convex portion 17*d* of the rotating lever 14. Thereby, the rotating lever 14 is detachably attached to the joint portion 16, but the rotating lever cannot be relatively rotated with the joint portion 16.

Moreover, a pair of fixing pins 13*a* and 13*b* is installed in the fixing washer 12 and the detent 7 while interposing the adjustment bolt 15. Insertion holes 12*e* and 12*f*, in which a pair of fixing pins 13*a* and 13*b* can be inserted, are formed in each washer 12*a* and 12*b* constituting the fixing washer 12.

In addition, a pair of fixing pins 13*a* and 13*b* are integrally formed with the joint portion 16, and are rotated about the adjustment bolt 15 due to the fact that the joint portion 16 is rotated. That is, the joint portion 16, the fixing washer 12, and the detent 7 are integrally rotated about the adjustment bolt 15 via a pair of fixing pins 13*a* and 13*b*.

(Detent)

Figure 5:
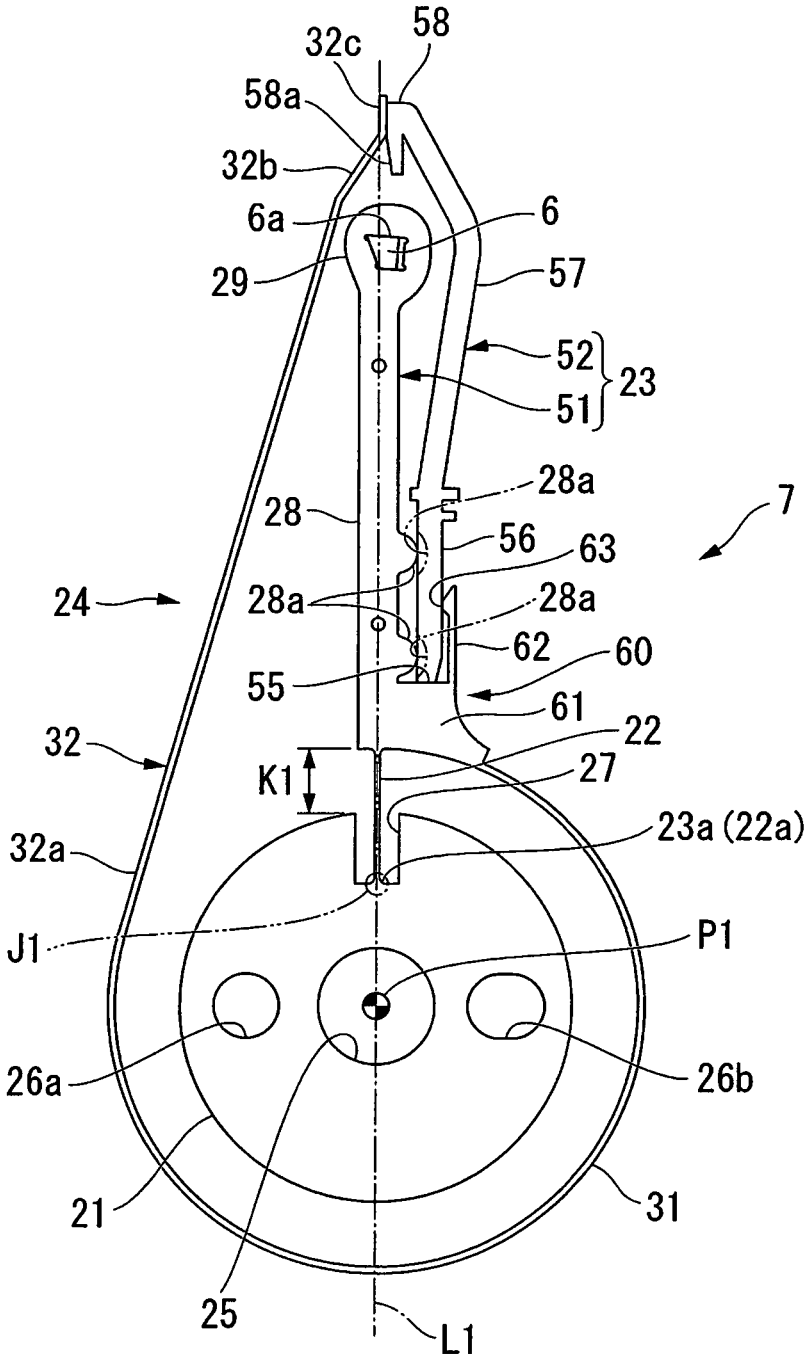
FIG. 5 is a plan view showing a detent according to the first embodiment of the invention.

FIG. 5 is a plan view showing the detent.

As shown in FIGS. 2 and 5, the detent 7 is integrally molded by a detent fixing portion 21 that is formed in a circular plate shape and interposed by the large-diameter washer 12*a* and the small-diameter washer 12*b* of the fixing washer 12, a blade 23 that is supported to the detent fixing portion 21 via a balance spring 22, and a one-side actuating spring 24 that can contact the unlocking stone 4.

Here, in methods for performing the integral molding, the detent 7 can be formed by an electroforming processing or a LIGA (Lithographie Galvanoformung Abformung) process adopting an optical method such as a photolithography.

The diameter of the detent fixing portion 21 is set so as to be approximately the same as the diameter of the small-diameter washer 12*b* which constitutes the fixing washer 12. A bolt insertion hole 25 into which the adjustment bolt 15 can be inserted is formed in the center in the radial direction of the detent fixing portion 21. Moreover, two pin insertion holes 26*a* and 26*b*, in which the fixing pins 13*a* and 13*b* can be inserted, are formed in the places corresponding to the fixing pins 13*a* and 13*b* of the detent fixing portion 21.

Here, one pin insertion hole 26*b* of two pin insertion holes 26*a* and 26*b* and one insertion hole 12*f* of two insertion holes 12*e* and 12*f* formed in the each washer 12*a* and 12*b* are formed in a long circular shape so as to allow for manufacturing errors of each part.

Moreover, a concave portion 27 is formed in the balance 5 side (the upside in FIG. 5) in the outer periphery of the detent fixing portion 21, and the balance spring 22 is erected in the concave portion 27. The balance spring 22 is formed in a plate shape along a straight line L1 which connects the base end 22*a* of the balance spring 22 and the center (the center of the axis) of the balance staff 9 of the balance 5. For example, it is desirable that the balance spring 22 is formed of an elastic material such as nickel, phosphor bronze, stainless steel, Elinvar, coelinvar, or the like.

The blade 23 installed in the tip of the balance spring 22 includes a blade main body 51 that is extended and installed along the straight line L1 from the tip of the balance spring 22, and a blade adjustment portion 52 that is formed so as to be separated from the blade main body 51 and in a bar shape.

The blade main body 51 is integrally molded by an arm 28 that is formed in a rectangular-parallelepiped shape along the straight line L1 and a locking stone attachment portion 29 that is disposed at the tip of the arm 28 and has greater width than that of the arm 28. The locking stone 6 that can contact the wheel tooth 2*a* of the escape wheel 2 is installed in the locking stone attachment portion 29. The cross-sectional shape of the locking stone 6 is formed in an approximately trapezoidal shape so as to be gradually wide in the width along toward the tip portion 58 of the blade adjustment portion 52 constituting the blade 23. In addition, the lower surface (the upper surface in FIGS. 2 and 5) of the locking stone 6 is set to a contact surface 6*a* which comes into contact with the wheel tooth 2*a* of the escape wheel 2.

Moreover, a snap fitting mechanism 60 (first snap fitting mechanism) for connecting the blade main body 51 and the blade adjustment portion 52 is integrally molded with the base end of the blade main body 51. The snap fitting mechanism 60 is integrally molded by a base portion 61 that is extended from the base end of the blade main body 51 toward a direction which is approximately perpendicular to the straight line L1, and an engagement piece 62 that is extended toward the tip side of the blade main body 51 along the straight line L1 from the tip of the base portion 61.

The engagement piece 62 is formed so as to be elastically deformed, and a hook 63 is integrally molded to the tip of the engagement piece 62 toward the blade main body 51 side. Moreover, the blade adjustment portion 52 is inserted into a concave portion 55 which is formed of the arm 28 of the blade main body 51, the base portion 61 of the snap fitting mechanism 60, and the engagement piece 62. According to the configuration, the blade adjustment portion 52 comes to be in the state where the blade adjustment portion is installed so as to slidably move in the concave portion 55 along the direction of the straight line L1, and the blade adjustment portion is fixed to the blade main body 51 by snap-fitting.

Here, in the arm 28 of the blade main body 51, a convex portion 28*a* is formed in two places at the position corresponding to the concave portion 55. By the convex portion 28*a*, the blade adjustment portion 52 and the engagement piece 62 are reliably snap-fitted.

The blade adjustment portion 52 is integrally formed by an attachment portion 56 that is inserted into the concave portion 55, an adjustment arm 57 that is extended from the tip of the attachment portion 56 toward the balance 5 side (the upside in FIG. 5) rather than the tip of the blade main body 51, and a tip portion 58 that is installed in the tip of the adjustment arm 57. The adjustment arm 57 is curved so as to avoid the locking stone attachment portion 29 of the blade main body 51.

The tip portion 58 is formed so that the abutting surface 58*a* of the tip portion 58 at the escape wheel 2 side is along the direction of the straight line L1 and is slightly offset toward the side (the right side in FIGS. 2 and 5) opposite to the escape wheel 2. The tip of the one-side actuating spring 24 abuts the abutting surface 58*a* of the tip portion 58 which is formed as described above.

Similarly to the balance spring 22, for example, it is desirable that the one-side actuating spring 24 is also formed of an elastic material such as nickel, phosphor bronze, stainless steel, Elinvar, coelinvar, or the like.

The one-side actuating spring 24 is formed in an approximate 6-shape form in plan view, and includes a circular arc portion 31 that is extended from the base portion 61 of the snap fitting mechanism 60 and a straight line portion 32 that is extended from the tip of the circular arc portion 31 toward the tip portion 58 of the blade adjustment portion 52. In addition, the straight line portion 32 is elastically deformed along the approaching and separating direction with respect to the blade 23.

The circular arc portion 31 is extended from the base end of the arm 28 toward the side opposite to the escape wheel 2 and along the direction which is approximately perpendicular to the straight line L1. Thereafter, the circular arc portion 31 is formed in a circular arc shape so as to enclose about ¾ of the periphery of the detent fixing portion 21. That is, after the circular arc portion 31 is extended from the base end of the arm 28 toward the side opposite to the balance 5 once, the circular arc portion 31 is formed in a circular arc shape so as to turn back toward the balance 5 side. The center of a curvature radius of the circular arc portion 31 approximately coincides with the center of the detent fixing portion 21, that is, a center P1 of the bolt insertion hole 25 which is formed in the detent fixing portion 21.

On the other hand, the straight line portion 32 includes: a gently inclined portion 32*a* that is extended so as to be gently inclined with respect to the straight line L1 from the tip of the circular arc portion 31; a steeply inclined portion 32*b* that is extend more steeply than the gently inclined portion 32*a* with respect to the straight line L1 from the tip of the gently inclined portion 32*a*, in which the tip of the steeply inclined portion abuts the tip portion 58; and a tongue 32*c* that is extended along the tip portion 58 from the steeply inclined portion 32*b*.

The gently inclined portion 32*a* is extended from the tip of the circular arc portion 31 to a position corresponding to the locking stone attachment portion 29. That is, the straight line portion 32 comes to be in a state where the straight line portion is extended and formed from the tip of the circular arc portion 31 toward the tip portion 58 of the blade adjustment portion 52 so as to avoid the interference between the straight line portion 32 and the locking stone attachment portion 29 of the blade 23.

In addition, the tip of the tongue 32*c* is extended and formed so as to be slightly protruded from the tip portion 58 of the blade adjustment portion 52 constituting the blade 23. The unlocking stone 4 of the balance 5 comes into contact with the region which is protruded from the tip portion 58 of the tongue 32*c*.

Here, in the straight line L1, the center P1 of the bolt insertion hole 25 of the detent fixing portion 21, the balance spring 22, the blade 23, and the balance staff 9 are installed in the same straight line. The blade 23 of the detent 7 constituted as described above has the base end 22*a* of the balance spring 22 as a fulcrum 23*a*, and the blade 23 can approach to and separate from the escape wheel 2 about the fulcrum 23*a*. That is, due to the fact that the balance spring 22 is elastically deformed so that the base end 22*a* is the center, the blade 23 is displaced along the approaching and separating direction with respect to the escape wheel 2.

The balance spring 22 biases the blade 23 so as to be returned to the original position. More specifically, as the state shown in FIGS. 2 and 5, the balance spring 22 biases the blade 23 to be returned the position in which the longitudinal direction of the arm 28 of the blade 23 is on the straight line L1. On the other hand, the spring force of the one-side actuating spring 24 is set to the degree such that the tongue 32*c* of the one-side actuating spring 24 can always abut the tip portion 58 of the blade adjustment portion 52.

In addition, since the balance spring 22 is formed in the concave portion 27 of the detent fixing portion 21, the separation distance K1 between the detent fixing portion 21 and the blade 23 can be secured with a sufficient length without being greatly set. Thereby, the balance spring 22 is constituted so that the blade 23 is sufficiently displaced along the approaching and separating direction of the escape wheel 2.

Here, the width of the concave portion 27 is set so that the displacement of the blade 23 along the approaching and separating direction is allowed with respect to the escape wheel 2. In addition, concave portions 16 and 17 each are formed at the region corresponding to the concave portion 27 of the detent fixing portion 21 in the large-diameter washer 12*a* and the small-diameter washer 12*b* that interpose the detent fixing portion 21. Thereby, even in the state where the detent 7 is fixed by each washer 12*a* and 12*b*, the blade 23 can be sufficiently displaced along the approaching and separating direction of the escape wheel 2.

In addition, since the one-side actuating spring 24 is constituted of the circular arc portion 31 and the straight line portion 32 and formed in an approximate 6-shape form in plan view, the position J1 of the center of gravity of entire detent 7 approximately coincides with the fulcrum 23*a* of the blade 23.

In the unlocking stone 4 that can contact the tongue 32*c* of the one-side actuating spring 24, the contact surface 4*a* of the unlocking stone 4, which comes into contact with the surface of the side opposite to the tip portion 58 of the tongue 32*c*, is formed so as to be along the tongue 32*c*. On the other hand, an inclined surface 4*b* is formed by chamfering at the side opposite to the contact surface 4*a* of the unlocking stone 4. Thereby, the cross-sectional shape of the unlocking stone 4 is like a trapezoid, which is tapered to go toward the outside in the radial direction of the large collar 11.

Here, when the detent 7 is attached, the position of the tip portion 58 of the blade adjustment portion 52 or the tongue 32*c* of the one-side actuating spring 24 is adjusted so that the tip of the unlocking stone 4 does not come into contact with the blade 23 and comes into contact with the tongue 32*c* of the one-side actuating spring 24 at the time of the free oscillation of the balance 5. Thereby, according to the free oscillation of the balance 5, the blade 23 can approach to or separate from the escape wheel 2 (the details will be described hereinafter).

As shown in FIG. 2, a stopper 40, which regulates the displacement toward the direction approaching to the escape wheel 2 of the blade 23, is installed in the main plate 102. The stopper 40 includes a stopper arm 41 and a stopper pin 42 which is erected in the tip of the stopper arm 41. In addition, the base end side of the stopper arm 41 is fixed to the main plate 102 via a fixing pin 43.

The stopper pin 42 abuts the blade main body 51 of the blade 23 from the escape wheel 2 side. Thereby, the displacement toward the direction approaching to the escape wheel 2 of the blade 23 is regulated.

Moreover, the stopper arm 41 is installed so as to be rotated about the fixing pin 43, and therefore, the position of the stopper pin 42 can be adjusted. Due to the fact that the position of the stopper pin 42 is adjusted, the movement regulating position of the blade 23 is set to the position in which the locking stone 6 can contact the wheel tooth 2*a* of the escape wheel 2 and the longitudinal direction of the arm 28 becomes the straight line L1.

(Operation of Detent Escapement)

Next, with reference to FIG. 2 and FIGS. 6 to 8, operation of the detent escapement 1 will be described.

Figure 6:
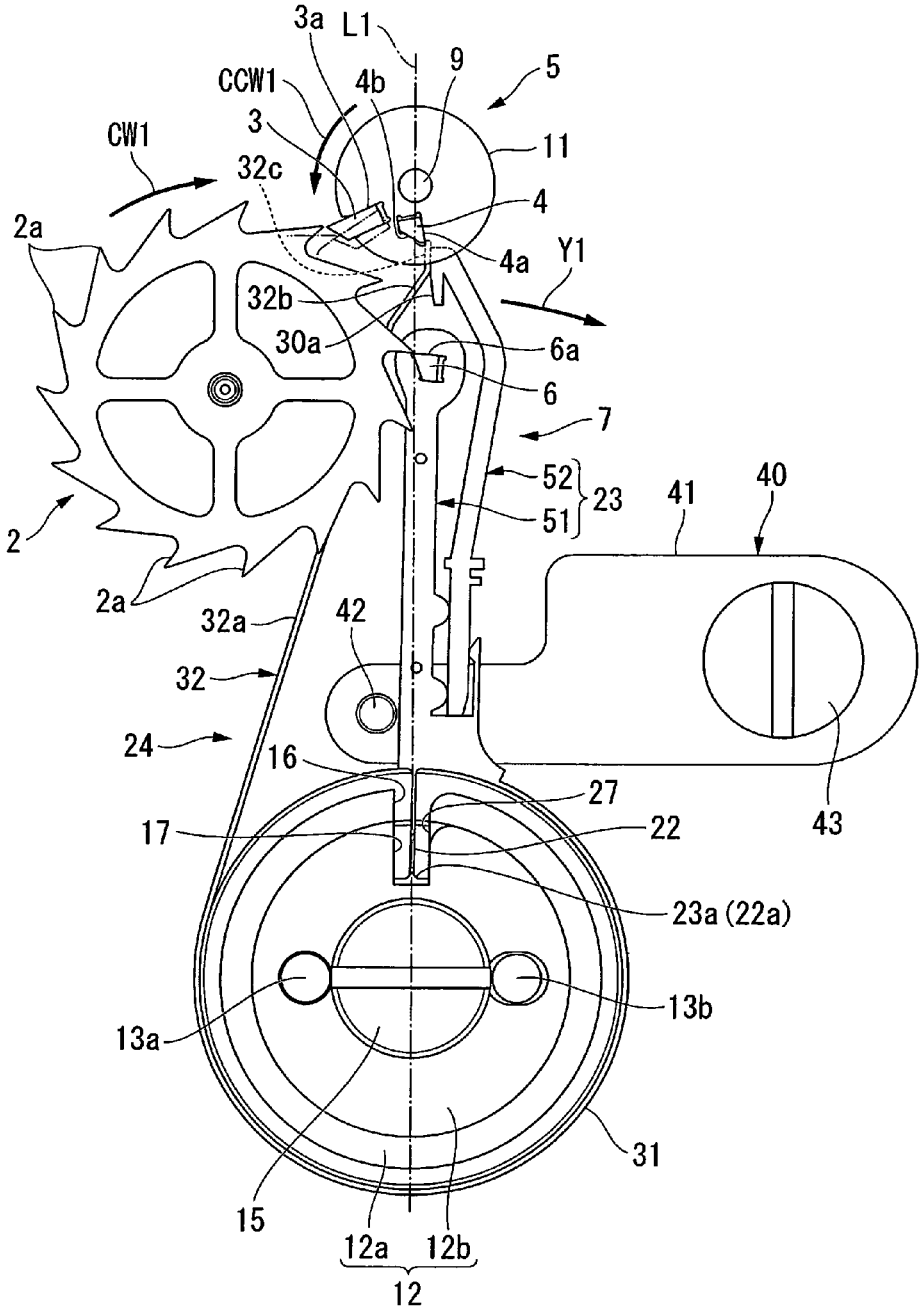
FIG. 6 is an explanatory diagram of operation of the detent escapement according to the first embodiment of the invention.
Figure 7:
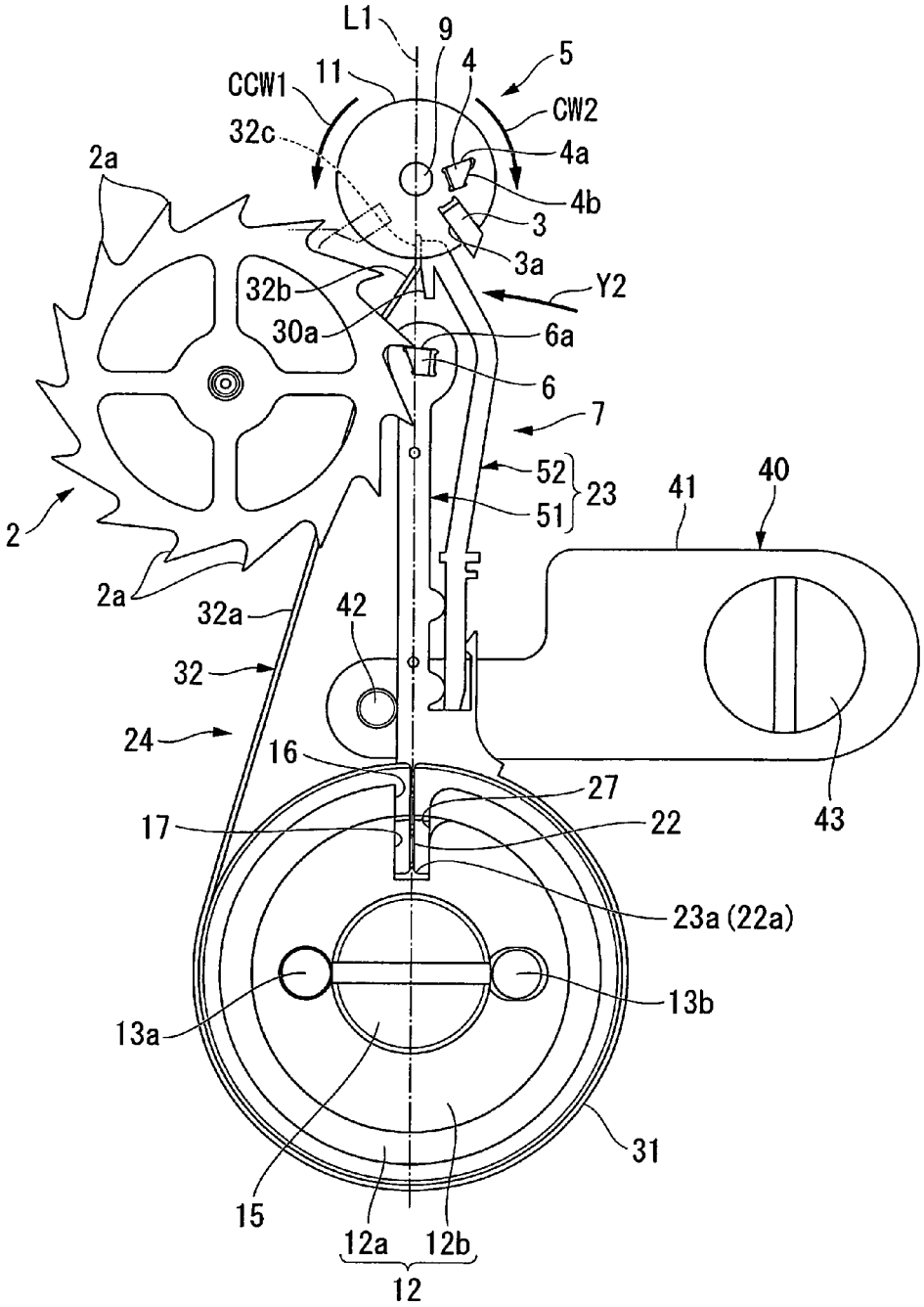
FIG. 7 is an explanatory diagram of operation of the detent escapement according to the first embodiment of the invention.
Figure 8:
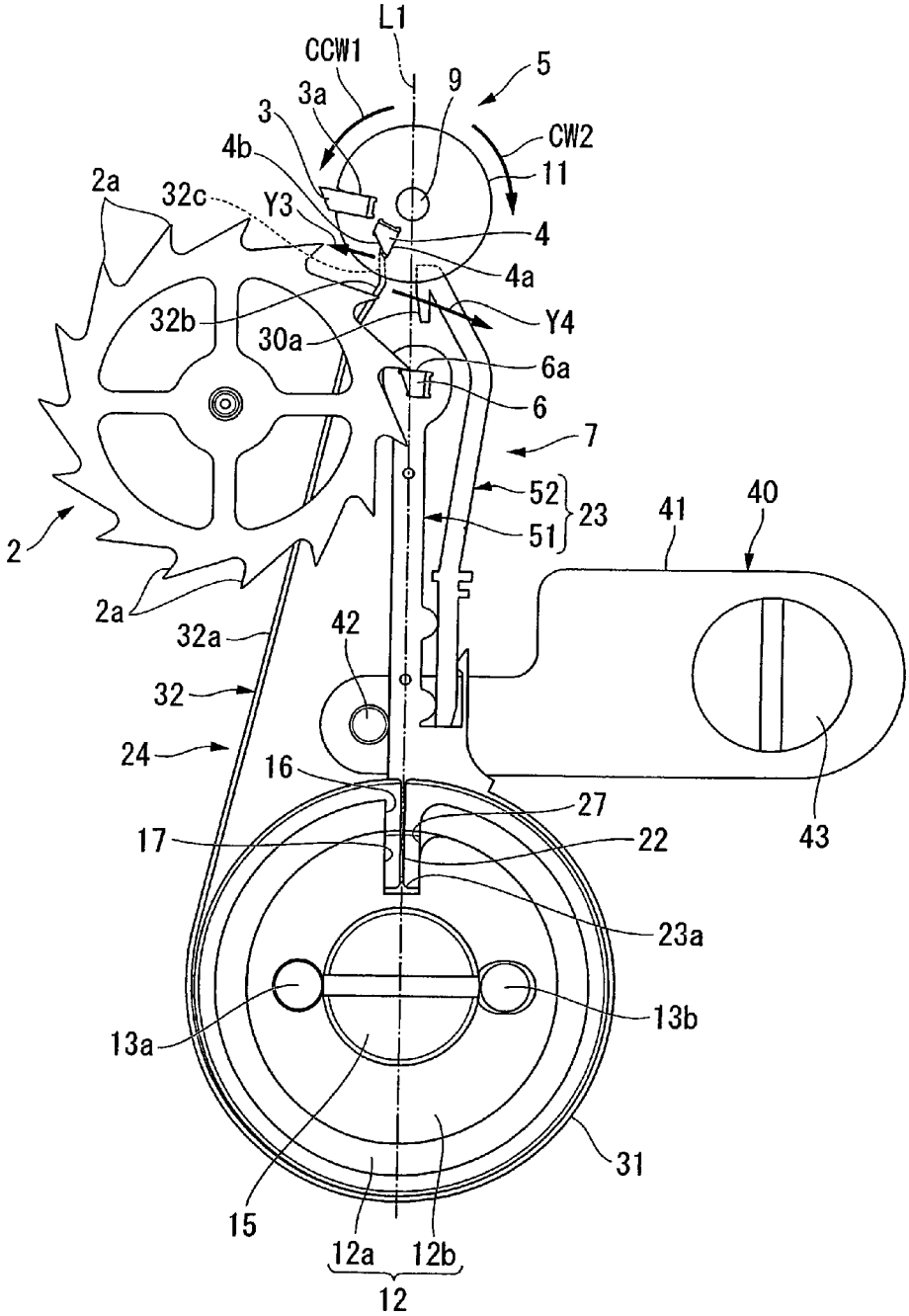
FIG. 8 is an explanatory diagram of operation of the detent escapement according to the first embodiment of the invention.

FIGS. 6 to 8 are explanatory diagrams of operation of the detent escapement.

As shown in FIG. 2, in a state where the blade main body 51 constituting the blade 23 of the detent 7 is presented at the position along the straight line L1, the wheel tooth 2*a* of the escape wheel 2 comes into contact with the contact surface 6*a* of the locking stone 6 which is installed at the blade 23, and the escape wheel 2 and the locking stone 6 are engaged with each other.

Here, the escape wheel 2 is subjected to the rotation force from the gear train 105. However, in the state where the escape wheel 2 is engaged with the locking stone 6, the escape wheel 2 is stopped.

From the above state, as shown in FIG. 6, due to the fact that the balance 5 is freely oscillated, if the large collar 11 is rotated in a direction of an arrow CW1 (a counterclockwise direction in FIG. 6), the contact surface 4*a* of the unlocking stone 4 installed in the large collar 11 abuts the tip of the tongue 32*c* of the one-side actuating spring 24. In addition, the blade 23 is pressed via the tongue 32*c* by the unlocking stone 4, and is displaced toward the direction (refer to an arrow Y1 in FIG. 6) which is separated from the escape wheel 2.

At this time, due to the fact that the balance spring 22 is elastically deformed so as to be bent, the blade 23 is displaced. However, with respect to this, the one-side actuating spring 24 is barely elastically deformed. That is, in the case where the tongue 32*c* is slightly displaced toward the direction (a direction of an arrow Y1 in FIG. 6) which is separated from the escape wheel 2, the one-side actuating spring 24 is formed in an approximate 6-shape form in plan view. In addition, since the straight line portion 32 is slightly displaced only in the direction in which the circular arc portion 31 is wound up, the one-side actuating spring 24 is barely elastically deformed.

Due to the fact that the blade 23 is displaced toward the direction which is separated from the escape wheel 2, the locking stone 6 installed in the blade 23 is separated from the wheel tooth 2*a* of the escape wheel 2, and engagement between the escape wheel 2 and the locking stone 6 is released. Thereby, the escape wheel 2 is rotated in a direction of an arrow CW1 (a clockwise direction in FIG. 6).

In addition, due to the fact the large collar 11 is rotated in the direction of the arrow CCW1, at approximately the same time that the escape wheel 2 starts the rotation in the direction of the arrow CW1, the contact surface 3*a* of the impulse jewel 3 comes into contact with the wheel tooth 2*a* of the escape wheel 2 (refer to a two dotted line in FIG. 6). Moreover, the rotation force of the escape wheel 2 is transmitted to the balance 5 via the impulse jewel 3. At this time, the rotation force in the direction of the arrow CCW 1 is applied to the balance 5.

As shown in FIG. 7, if the large collar 11 is rotated by a predetermined angle in a direction of an arrow CCW1 (a counterclockwise direction in FIG. 7), the unlocking stone 4 is separated from the tip of the tongue 32*c* of the one-side actuating spring 24. Then, by the restoration force of the balance spring 22, the blade 23 is displaced toward the direction (refer to an arrow Y2 in FIG. 7) which approaches to the escape wheel 2. At this time, the displacement of the blade 23 is regulated by the stopper 40, and the blade 23 is returned to the original position.

Due to the fact that the blade 23 is returned to the original position, the wheel tooth 2*a* of the rotating escape wheel 2 abuts the contact surface 6*a* of the locking stone 6, and the escape wheel 2 and the locking stone 6 are again engaged with each other. Thereby, the rotation of the escape wheel 2 is stopped. Here, during from the time when the engagement between the escape wheel 2 and the locking stone 6 is released to the time when the escape wheel 2 and the locking stone 6 are again engaged with each other, the escape wheel 2 is rotated by only one tooth.

On the other hand, the balance 5 to which the rotation force toward the direction of the arrow CCW1 is applied by the escape wheel 2 can wind up the hairspring which is installed in the balance 5. Moreover, if the hairspring is wound up by a predetermined amount, the restoration force of the hairspring and the rotation force of the balance 5 are reversed, and the rotation direction of the large collar 11 is changed to the direction of the arrow CW2 (a clockwise direction in FIG. 7).

As shown in FIG. 8, if the large collar 11 is rotated in the direction of the arrow CW2, the inclined surface 4*b* of the unlocking stone 4 comes into contact with the tip of the tongue 32*c* of the one-side actuating spring 24. In addition, due to the fact that the large collar 11 is further rotated, the tongue 32*c* of the one-side actuating spring 24 is pressed toward the direction which is separated from the blade 23, that is, the direction toward the escape wheel 2 (refer to an arrow Y3). Then, the one-side actuating spring 24 is elastically deformed so that the straight line portion 32 is pressed and expanded.

In addition, if the large collar 11 is rotated in the direction of the arrow CW2 and reach at a predetermined angle, the unlocking stone 4 is separated from the tongue 32*c* of the one-side actuating spring 24. Then, due to the restoration force of the one-side actuating spring 24, the tongue 32*c* is displaced toward the blade 23 side (refer to an arrow Y4 in FIG. 8) and returned to the original position.

On the other hand, while the large collar 11 is rotated in the direction of the arrow CW2, the hairspring installed in the balance 5 is rewound. Moreover, if the hairspring is rewound by a predetermined amount, the restoration force of the hairspring and the rotation force of the balance 5 are reversed, and the rotation direction of the large collar 11 is again changed to the direction of the arrow CCW1 (a counterclockwise direction in FIG. 8).

By repeating this, the balance 5 is freely oscillated about the balance staff 9, and the detent 7 repeatedly performs the states shown in FIG. 2 and FIGS. 6 to 8. Thereby, the escape wheel 2 is always rotated at a constant speed.

(Detent Attachment Adjusting Method)

Next, with reference to FIGS. 3 to 5, a method for adjusting the attachment of the detent 7 will be described.

Here, as described above, it is necessary to adjust the detent 7 so that the tongue 32*c* of the one-side actuating spring 24 is positioned on the trajectory of the tip of the unlocking stone 4 and the tip portion 58 of the blade adjustment portion 52 constituting the blade 23 is positioned to avoid the trajectory of the tip of the unlocking stone 4 at the time of the free oscillation of the balance 5. In this way, in order to dispose the unlocking stone 4, the blade 23, and the one-side actuating spring 24 to desired positions, it is preferable to adjust as follows.

That is, due to the fact that the relative position between the unlocking stone 4 and the tongue 32*c* of the actuating spring 24 and the relative position between the tongue 32*c* and the tip portion 58 of the blade adjustment portion 52 are adjusted, the unlocking stone 4, the blade 23, and the one-side actuating spring 24 can be disposed to desired positions.

First, with reference to FIGS. 3 and 4, the adjustment method of the relative position between the unlocking stone 4 and the tongue 32*c* of the one-side actuating spring 24 will be described.

As shown in FIGS. 3 and 4, since the adjustment bolt 15 of the angle adjustment mechanism 19 is slightly loosened in advance, the joint portion 16 is caused to be rotatable about the main plate 102. In the above state, if the rotating lever 14 is rotated, the rotating lever is integral with the joint portion 16, and the detent 7 is rotated about the adjustment bolt 15.

Due to the fact that the detent 7 is rotated, the relative position relationship between the tongue 32*c* of the one-side actuating spring 24 and the unlocking stone 4 is changed. Therefore, the tongue 32*c* of the one-side actuating spring 24 is disposed at a desired position. Thereafter, the adjustment bolt 15 is more tightened, and therefore, the detent 7 can be fastened and fixed to the main plate 102. Continuously, the rotating lever 14 is removed from the joint portion 16, the adjustment of the relative position between the unlocking stone 4 and the tongue 32*c* of the one-side actuating spring 24 is completed.

Next, with reference to FIG. 5, the adjustment method of the relative position between the tongue 32*c* of the one-side actuating spring 24 and the tip portion 58 of the blade adjustment portion 52 will be described.

As shown in FIG. 5, the attachment portion 56 of the blade adjustment portion 52 is inserted into the concave portion 55 of the blade 23, and is fixed by snap-fitting through the engagement piece 62. Thereby, the blade adjustment portion 52 can slidably move along the inserting and removing direction from the concave portion 55. If the blade adjustment portion 52 slidably moves toward the extracting direction from the concave portion 55, the amount of the tongue 32*c* of the one-side actuating spring 24 which is protruded from the tip portion 58 is decreased.

On the other hand, if the blade adjustment portion 52 slidably moves toward the inserting direction in the concave portion 55, the amount of the tongue 32*c* of the one-side actuating spring 24 which is protruded from the tip portion 58 is increased. In this way, the blade adjustment portion 52 slidably moves along the inserting and removing direction from the concave portion 55, and the tip portion 58 of the blade adjustment portion 52 is adjusted so as to be positioned at a desired position. In addition, since the blade adjustment portion 52 is fixed with respect to the blade main body 51 by snap-fitting, the blade adjustment portion 52 can be fixed in the state after the adjustment.

(Effect)

Therefore, according to the above-described first embodiment, due to the fact that the detent 7 can be fixed to the main plate 102 via the angle adjustment mechanism 19, the adjustment of the relative position between the unlocking stone 4 and the tongue 32*c* of the one-side actuating spring 24 can be easily performed with high accuracy. In addition, since the blade 23 of the detent 7 is constituted so that the blade main body 51 and the blade adjustment portion 52 are separated from each other, the adjustment of the relative position between the tongue 32*c* of the one-side actuating spring 24 and the tip portion 58 of the blade adjustment portion 52 can be easily performed with high accuracy. As a result, the unlocking stone 4 and the one-side actuating spring 24 come to be in a desired contact state while the unlocking stone 4 and the blade 23 cannot contact each other. Therefore, the blade 23 and the one-side actuating spring 24 can be appropriately operated, and the escape wheel 2 can be reliably normally operated.

In addition, since the adjustment of the relative position between the tongue 32*c* of the one-side actuating spring 24 and the tip portion 58 of the blade adjustment portion 52 is performed, the adjustment can be realized only due to the fact that the blade 23 is constituted so that the blade main body 51 and the blade adjustment portion 52 are separated from each other. Thereby, an increase in manufacturing cost of the detent 7 can be suppressed.

In addition, since the blade main body 51 and the blade adjustment portion 52 are connected to each other via the snap fitting mechanism 60, the position adjustment and the fixing of the blade adjustment portion 52 can be easily performed. Moreover, the position adjustment of the blade adjustment portion 52 with respect to the blade main body 51 can be easily performed.

In addition, in the first embodiment, the following case is described. By slidably moving the blade adjustment portion 52 with respect to the blade main body 51 of the blade 23, the amount in which the tongue 32*c* of the one-side actuating spring 24 is protruded from the tip portion 58, that is, the relative position between the tip portion 58 of the blade adjustment portion 52 and the tongue 32*c* of the one-side actuating spring 24 is adjusted.

However, the invention is not limited to this. That is, the tip portion 58 of the blade adjustment portion 52 may swing about the base end of the attachment portion 56, and the tip portion 58 and the tongue 32*c* may be adjusted so as to reliably contact each other.

Here, since the tip portion 58 of the blade adjustment portion 52 and the tongue 32*c* of the one-side actuating spring 24 can reliably contact each other, at least the width of the tip portion 58 of the blade adjustment portion 52 may be set to the width which can reliably contact the tongue 32*c*. In this case, since the blade adjustment portion 52 is separated from the blade main body 51, the manufacturing method of the blade adjustment portion 52 alone may be changed, and a large change in the manufacturing process of the detent 7 can be prevented.

In addition, in the attachment portion 56 of the blade adjustment portion 52, the concave portion 56*a* (refer to the two dotted line in FIG. 5), which can receive the convex portion 28*a*, may be formed in the position corresponding to the convex portion 28*a* formed in the blade main body 51. Due to the fact that the concave portion 56*a* is formed, the fixing strength of the blade adjustment portion 52 with respect to the blade main body 51 can be improved.

Moreover, due to the fact that the concave portion 56*a* is formed along the width direction of the attachment portion 56, the blade adjustment portion 52 can slidably move in the width direction with respect to the blade main body 51. Due to the fact that the blade adjustment portion 52 slidably moves the width direction and position thereof is adjusted, the tip portion 58 of the blade adjustment portion 52 and the tongue 32*c* of the one-side actuating spring 24 can also reliably be made to contact each other.

Second Embodiment

Next, a second embodiment of the invention will be described with reference to FIG. 9. In addition, with respect to the same aspect as the first embodiment, the same reference number is denoted and description thereof is omitted (embodiments described below are similarly applied).

Figure 9:
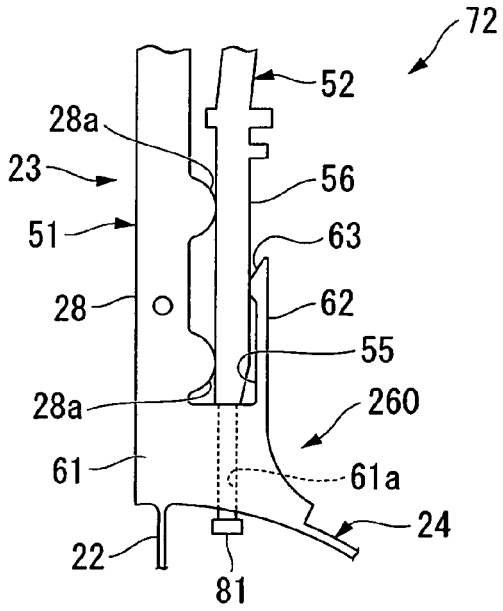
FIG. 9 is a main portion plan view of a detent according to a second embodiment of the invention.

FIG. 9 is a main portion plan view of the detent according to the second embodiment.

In the second embodiment, the basic configurations as follows are the same as the first embodiment (embodiments described below are similarly applied): the mechanical timepiece 100 includes the movement 101; the detent escapement 1 which controls the rotation of the gear train 105 is disposed in the front side of the movement 101; the detent escapement 1 includes the escape wheel 2 that is rotated due to the fact that the second wheel & pinion 106 is rotated, the detent 72 including the locking stone 6 that can contact the wheel tooth 2*a* of the escape wheel 2, the impulse jewel 3 that can contact the wheel tooth 2*a* of the escape wheel 2, and the balance 5 including the unlocking stone 4 that can contact the detent 72; the detent 72 is fixed to the main plate 102 via the angle adjustment mechanism 19; the blade 23 of the detent 72 is extended along the straight line L1, and the like.

Here, as shown in FIG. 9, the differences between the second embodiment and the first embodiment are as follows. That is, in the detent 72 of the second embodiment, a position determination bolt 81 having the role as the position determination mechanism of the blade adjustment portion 52 is installed in the snap fitting mechanism 260.

More specifically, a female screw 61*a* that can screw the position determination bolt 81 is formed in a base portion 61 of the snap fitting mechanism 260. The position determination bolt 81 is screwed into the female screw 61*a* from the detent fixing portion 21 side (the downside in FIG. 9). The length of the position determination bolt 81 is set to a length in which the tip of the position determination bolt can sufficiently protrude toward the concave portion 55 side of the base portion 61.

According to the configuration, in the case where the relative position between the tongue 32*c* of the one-side actuating spring 24 and the tip portion 58 of the blade adjustment portion 52 is adjusted, first, the amount in which the position determination bolt 81 is protruded from the base portion 61 is adjusted. Thereafter, the blade adjustment portion 52 is set so that the attachment portion 56 of the blade adjustment portion 52 abuts the tip of the position determination bolt 81. Thereby, the adjustment of the relative position between the tongue 32*c* of the one-side actuating spring 24 and the tip portion 58 of the blade adjustment portion 52 is completed.

Therefore, according to the second embodiment, in addition to effects similar to those of the first embodiment described above, the position adjustment of the blade adjustment portion 52 can be more easily performed.

Third Embodiment

Next, a third embodiment of the invention will be described with reference to FIG. 10.

Figure 10:
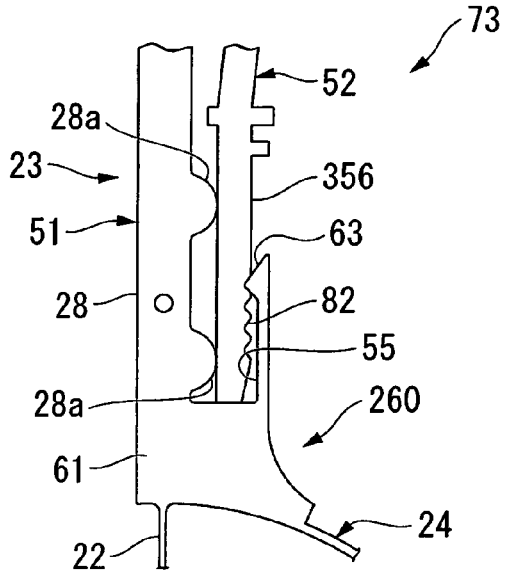
FIG. 10 is a main portion plan view of a detent according to a third embodiment of the invention.

FIG. 10 is a main portion plan view of the detent according to the third embodiment.

As shown in FIG. 10, the differences between the third embodiment and the first embodiment are as follows. That is, in the detent 73 of the third embodiment, a plurality of grooves 82 capable of engaging with the hook 63 of the engagement piece 62 is formed in the attachment portion 356 of the blade adjustment portion 52. In addition, according to a plurality of the grooves 82, the blade adjustment portion 52 can slidably move with respect to the blade main body 51 stepwise.

In this way, due to the grooves 82 and the hook 63, a function as the positioning mechanism of the blade adjustment portion 52 is achieved. Therefore, according to the third embodiment, effects similar to those of the second embodiment can be achieved.

Fourth Embodiment

Next, a fourth embodiment of the invention will be described with reference to FIG. 11.

Figure 11:
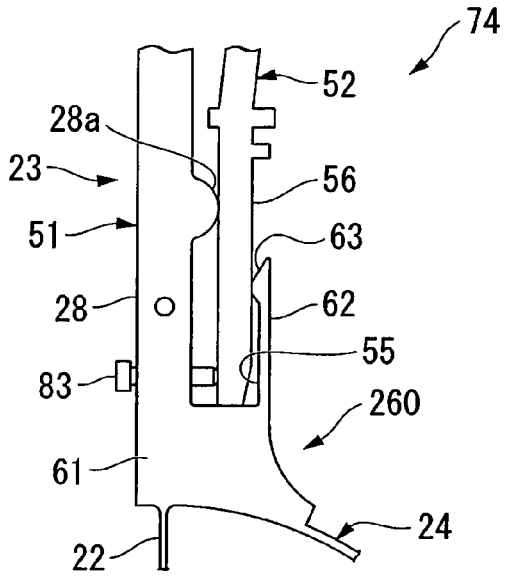
FIG. 11 is a main portion plan view of a detent according to a fourth embodiment of the invention.

FIG. 11 is a main portion plan view of the detent according to the fourth embodiment of the invention.

As shown in FIG. 11, the differences between the fourth embodiment and the first embodiment are as follows. That is, in the detent 74 of the fourth embodiment, a fixing bolt 83 is installed in the position corresponding to the concave portion 55 of the blade main body 51.

More specifically, the fixing bolt 83 is screwed into the blade main body 51 so that the tip of the fixing bolt is protruded toward the attachment portion 56 of the blade adjustment portion 52.

Therefore, according to the fourth embodiment, in addition to effects similar to those of the first embodiment described above, the blade adjustment portion 52 can be more reliably fixed. Moreover, due to the fact that the protruded amount of the fixing bolt 83 is adjusted, the inclination of the blade adjustment portion 52 can also be changed with the convex portion 28*a* as the fulcrum. Thereby, it is possible to expand the adjustment range of the tip portion 58 of the blade adjustment portion 52.

Fifth Embodiment

Next, a fifth embodiment of the invention will be described with reference to FIG. 12.

Figure 12:
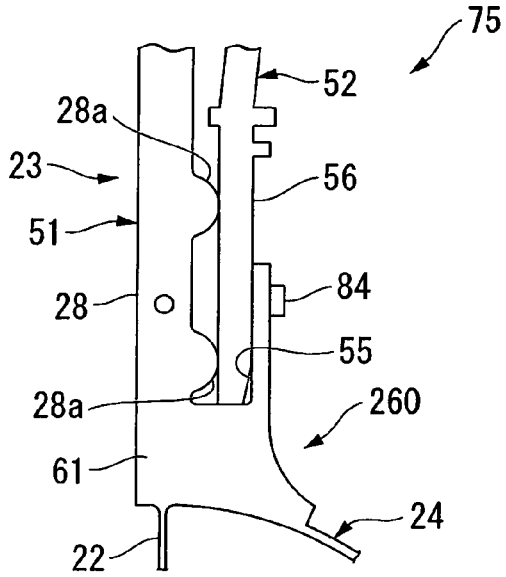
FIG. 12 is a main portion plan view of a detent according to a fifth embodiment of the invention.

FIG. 12 is a main portion plan view of the detent according to the fifth embodiment.

As shown in FIG. 12, the differences between the fifth embodiment and the first embodiment are as follows. That is, in the detent 75 of the fifth embodiment, a fixing bolt 84 is installed in the engagement piece 62 of the snap fitting mechanism 60 instead of the hook 63.

Therefore, according to the fifth embodiment, in addition to the effects similar to those of the first embodiment, the blade adjustment portion 52 can be more reliably fixed.

Sixth Embodiment

Next, a sixth embodiment of the invention will be described with reference to FIG. 13.

Figure 13:
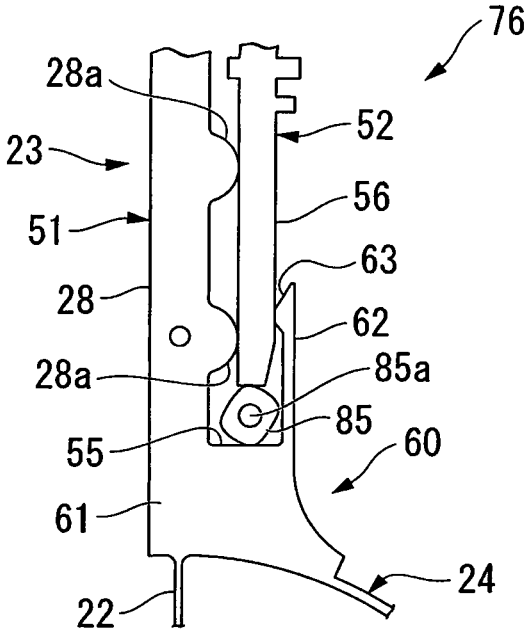
FIG. 13 is a main portion plan view of a detent according to a sixth embodiment of the invention.

FIG. 13 is a main portion plan view of the detent according to the sixth embodiment.

As shown in FIG. 13, the differences between the sixth embodiment and the first embodiment are as follows. That is, in the snap fitting mechanism 60 of the detent 76 of the sixth embodiment, a position adjustment cam 85 is installed in the bottom portion of the concave portion 55.

The blade adjustment portion 52 is housed in the concave portion 55 so that the base end of the attachment portion 56 of the blade adjustment portion abuts the position adjustment cam 85. The position adjustment cam 85 is installed so as to be rotated about a rotation pin 85*a*, and due to the fact that the position adjustment cam 85 is rotated, the separation distance between the bottom portion of the concave portion 55 and the base end of the attachment portion 56 is changed. Thereby, the adjustment of the relative position between the tongue 32*c* of the one-side actuating spring 24 and the tip portion 58 of the blade adjustment portion 52 can be performed.

Therefore, according to the above-described sixth embodiment, in addition to the effects similar to those of the first embodiment described above, the position adjustment of the blade adjustment portion 52 can be more easily performed.

Seventh Embodiment

Next, a seventh embodiment of the invention will be described with reference to FIG. 14.

Figure 14:
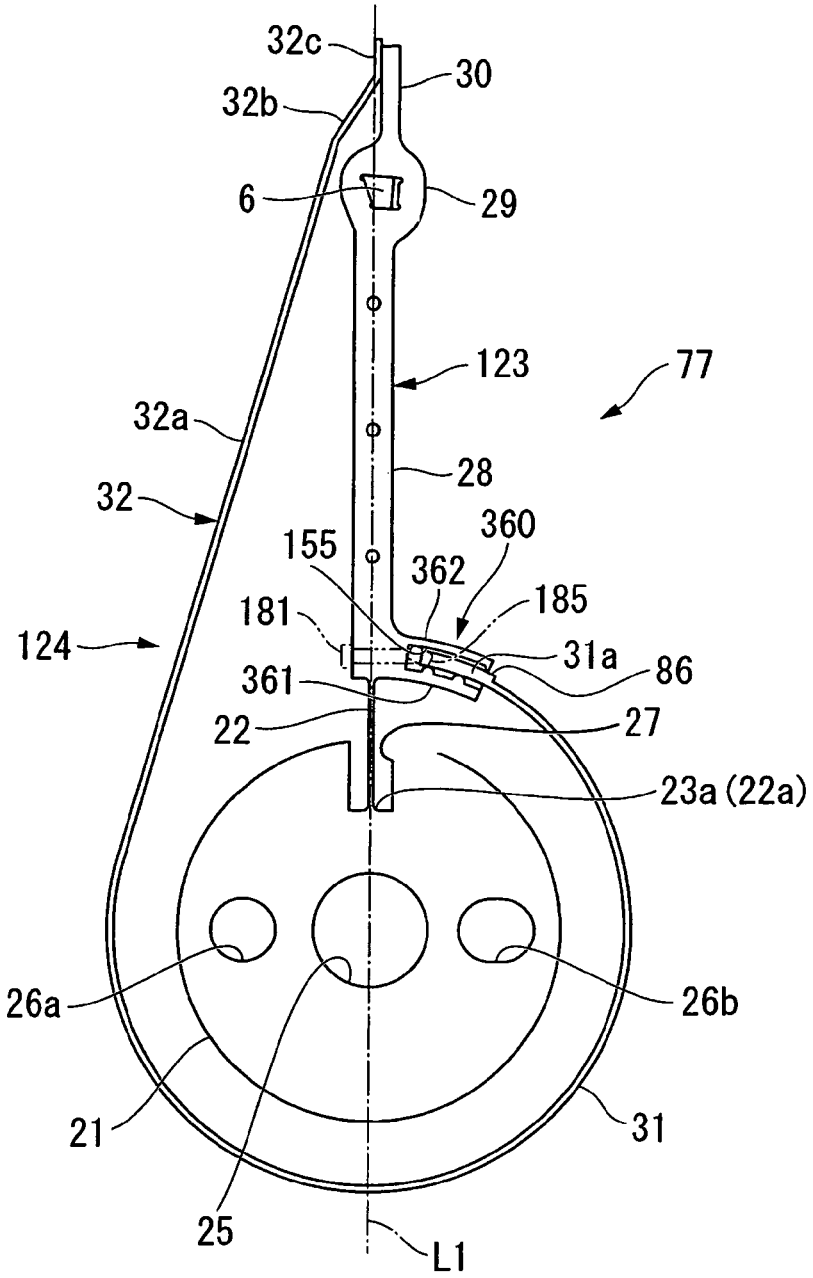
FIG. 14 is a plan view of a detent according to a seventh embodiment of the invention.

FIG. 14 is a plan view of the detent according to the seventh embodiment.

As shown in FIG. 14, the differences between the seventh embodiment and the first embodiment are as follows. That is, in the first embodiment, the blade 23 of the detent 7 is constituted so that the blade main body 51 and the blade adjustment portion 52 are separated from each other, and the one-side actuating spring 24 is integrally molded to the blade main body 51. On the other hand, in the seventh embodiment, the blade 123 of the detent 77 is not constituted to be separated, and the blade 123 and the one-side actuating spring 124 are constituted so as to be separated from each other.

That is, the blade 123 is integrally molded by an arm 28 that is integrally molded to the tip of the balance spring 22 and extended and formed along the straight line L1, a locking stone attachment portion 29 that is disposed in the tip side of the arm 28 and has a larger width than that of the arm 28, and a tip portion 30 that is disposed in the furthermore tip side than the locking stone attachment portion 29 and is thinner than the arm 28 and formed in a rectangular shape. A snap fitting mechanism 360 (second snap fitting mechanism) for connecting the blade 123 and the one-side actuating spring 124 is integrally molded to the base end of arm 28.

The snap fitting mechanism 360 is integrally molded by a base portion 361 that is extended so as to correspond to the circular arc portion 31 of the one-side actuating spring 24 from the base end of the arm 28, and an engagement piece 362 that is extended so as to be approximately parallel to the base portion 361 from the furthermore tip side (the upside in FIG. 13) rather than the base portion 361 of the arm 28.

Moreover, an attachment portion 86 that is integrally formed to the terminal portion (the base end) of the circular arc portion 31 in the one-side actuating spring 124 is inserted into a concave portion 155 formed by the arm 28, the base portion 361, and the engagement piece 362. Thereby, the blade 123 and the one-side actuating spring 124 are fixed by snap-fitting.

According to the configuration, if the attachment portion 86 of the one-side actuating spring 124 slidably move along the extracting direction from the concave portion 155, the tongue 32*c* of the one-side actuating spring 124 is slightly displaced toward the direction in which the tongue 32*c* presses the tip portion 30 of the blade 123. At this time, since the one-side actuating spring 124 has elasticity, the tongue 32*c* slidably moves along the tip portion 30, that is, slidably moves toward the direction which is protruded from the tip portion 30 while the one-side actuating spring 124 is elastically deformed.

Therefore, according to the seventh embodiment described above, due to the fact that the attachment position of the one-side actuating spring 124 is adjusted, the relative position between the tip portion 30 of the blade 123 and the tongue 32*c* of the one-side actuating spring 124 can be adjusted. Thereby, effects similar to those of the first embodiment described above can be achieved.

In addition, in the seventh embodiment described above, the position determination bolt 181 or the position adjustment cam 185 may be installed in the snap fitting mechanism 360 (refer to a two dotted line in FIG. 14). Moreover, the position determination bolt 181 or the position adjustment cam 185 may function as a position determination mechanism for adjusting the attachment position of the one-side actuating spring 124.

In addition, in the seventh embodiment described above, the following case is described. That is, the relative position between the tip portion 30 of the blade 123 and the tongue 32*c* of the one-side actuating spring 124 is adjusted due to the fact that the attachment position of the entire one-side actuating spring 124 is adjusted. However, the invention is not limited to this. That is, the one-side actuating spring 124 may be constituted so that at least the tongue 32*c* slidably moves with respect to the blade 123.

Eighth Embodiment

Next, an eighth embodiment of the invention will be described with reference to FIG. 15.

Figure 15:
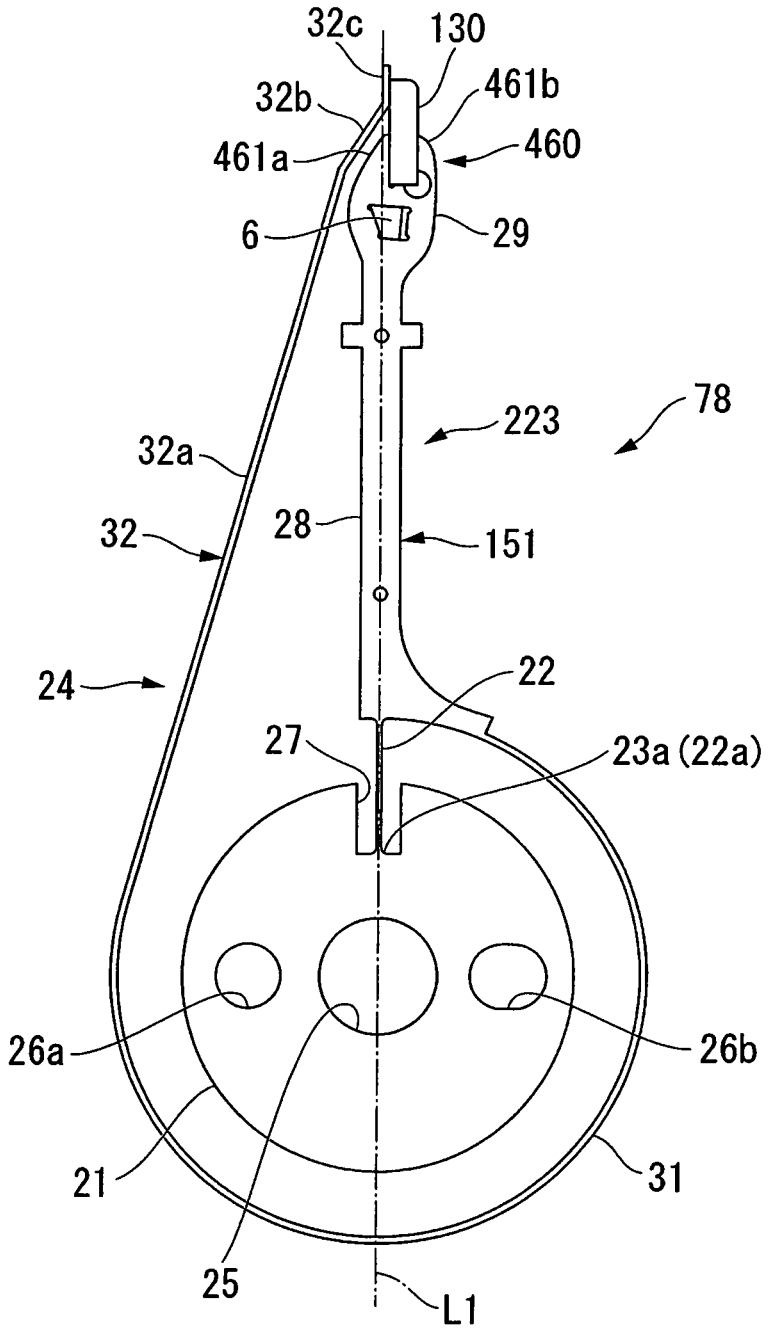
FIG. 15 is a plan view of a detent according to an eighth embodiment of the invention.
Figure 16:
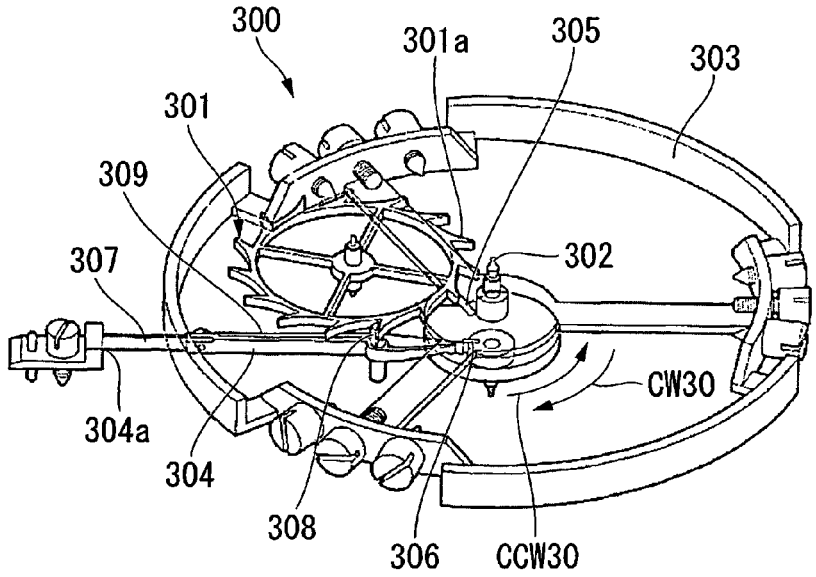
FIG. 16 is a perspective view showing an example of a spring detent escapement of the related art.
Figure 17:
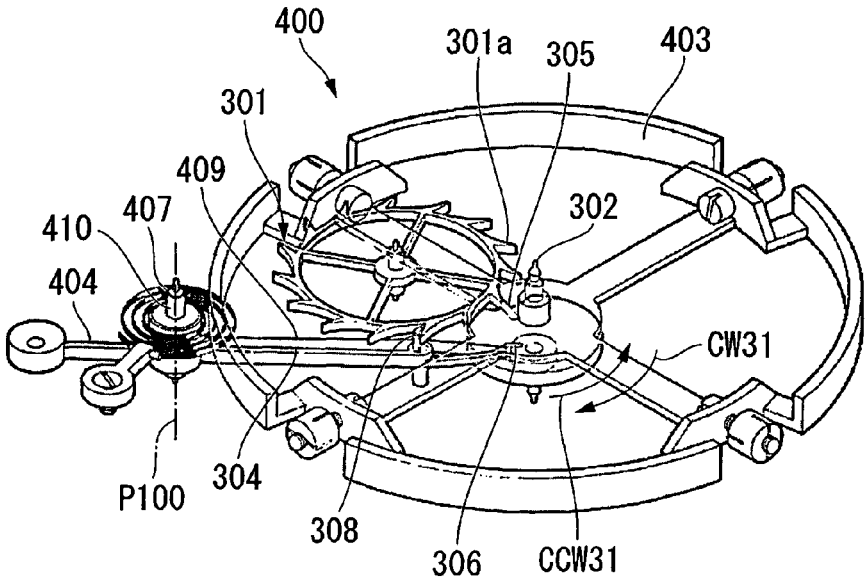
FIG. 17 is a perspective view showing an example of a pivoted detent escapement of the related art.

FIG. 15 is a plan view of a detent according to an eighth embodiment.

As shown in FIG. 15, the differences between the eighth embodiment and the first embodiment are as follows. In the first embodiment, the blade 23 of the detent 7 is constituted so that the blade main body 51 and the blade adjustment portion 52 are separated from each other. On the other hand, in the eighth embodiment, only the tip of the blade 223 of the detent 78 is constituted so as to be separated.

That is, the blade 223 is constituted so that the blade main body 151 that is integrally molded to the tip of the balance spring 22 and a plate shaped tip portion 130 that is installed in the tip of the blade main body 151 are separated from each other.

The blade main body 151 is integrally molded by the arm 28 of the balance spring 22 side, and the locking stone attachment portion 29 that is disposed in the tip side of the arm 28 and has a larger width than that of the arm 28.

A snap fitting mechanism 460 is integrally molded to the tip of the locking stone attachment portion 29, and the tip portion 130 is connected via the snap fitting mechanism 460.

The snap fitting mechanism 460 includes two-forked claws 461*a* and 461*b* which are protruded toward the tip portion 130 side from the locking stone attachment portion 29 of the blade main body 151. From among the two claws 461*a* and 461*b*, 461*b* is formed so as to be elastically deformed.

According to the configuration, if the tip portion 130 is inserted between two claws 461*a* and 461*b*, each claw 461*a* and 462*b* and the tip portion 130 are fixed by snap-fitting. Moreover, the tip portion 130 is installed so as to slidably move in the inserting and extracting direction of the claws 461*a* and 461*b*, that is, along the longitudinal direction of the blade main body 151.

Therefore, according to the eighth embodiment described above, the relative position between the tip portion 130 and the tongue 32*c* of the one-side actuating spring 124 can be adjusted, and therefore, the eighth embodiment can achieve effects similar to those of the first embodiment.

In addition, in the eighth embodiment, the snap fitting mechanism 460 and the tip portion 130 may be constituted so as to swing about the base end side of the tip portion 130, that is, the locking stone attachment portion 29 side of the blade main body 151. According to the configuration, the tip portion 130 and the tongue 32*c* of the one-side actuating spring 24 can reliably contact each other. In addition, it is desirable that the width of the tip portion 130 is set to be larger than that of the tongue 32*c* of the one-side actuating spring 24. Due to the fact the width of the tip portion 130 is set as described above, the tip portion 130 and the tongue 32*c* of the one-side actuating spring 24 can reliably contact each other.

Ninth Embodiment

Next, a ninth embodiment of the invention will be described with reference to FIG. 18.

Figure 18:
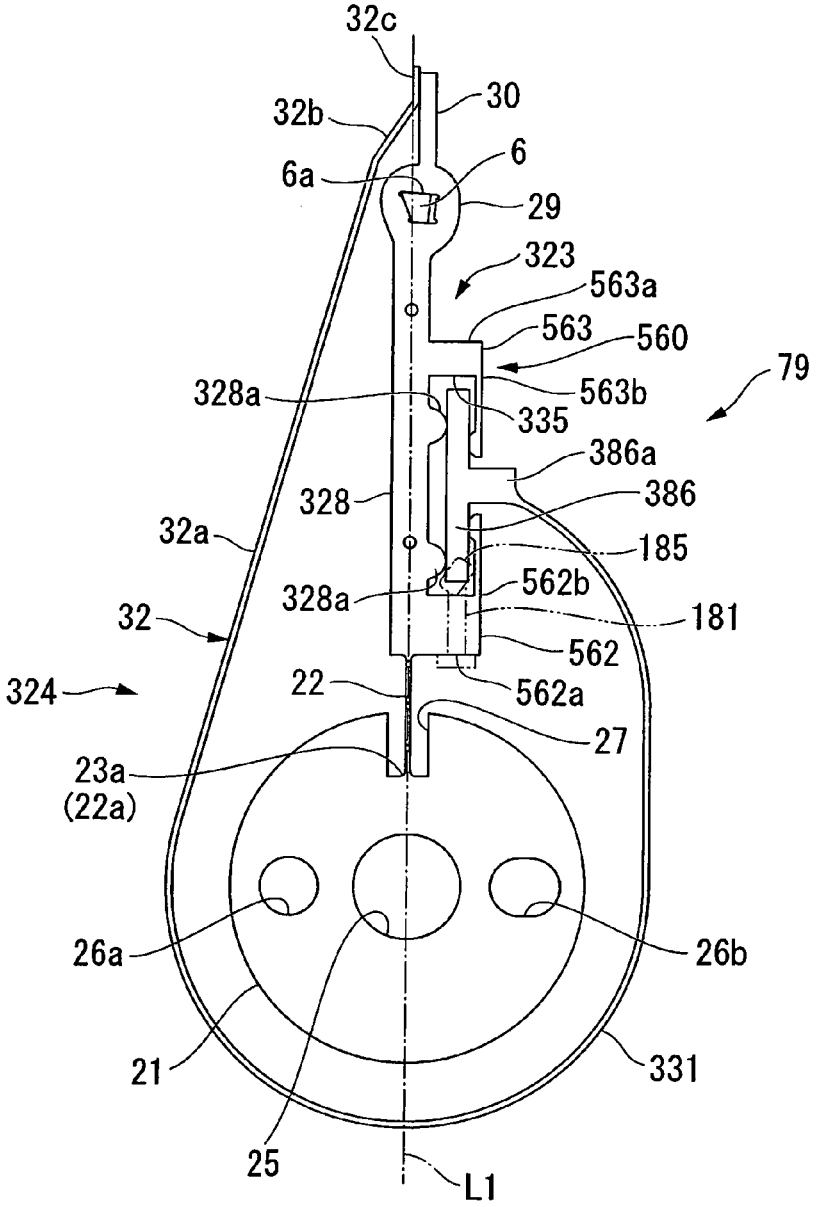
FIG. 18 is a plan view of a detent according to a ninth embodiment of the invention.

FIG. 18 is a plan view of the detent according to the ninth embodiment.

As shown in FIG. 18, the difference between the ninth embodiment and the seventh embodiment is as follows. That is, the configuration for adjusting the attachment position of the one-side actuating spring 124 in the detent 77 of the seventh embodiment is different to the configuration for adjusting the attachment position of the one-side actuating spring 324 in the detent 79 of the ninth embodiment.

That is, the snap fitting mechanism 560 for connecting the blade 323 and the one-side actuating spring 324 is integrally molded to the arm 328 of the blade 323. The snap fitting mechanism 560 is constituted of a pair of engagement pieces 562 and 563 which is oppositely disposed along the longitudinal direction of the arm 328.

One engagement piece 562 of a pair of engagement pieces 562 and 563 is integrally molded by a raised portion 562*a* that is protruded from the base end of the arm 328 to the direction approximately perpendicular to the straight line L1 and toward the side (the right side in FIG. 18) opposite to the escape wheel 2, and claw 562*b* that is bent and extended toward the tip portion 30 of the blade 323 from the tip of the raised portion 562*a*.

In addition, the other engagement piece 563 of a pair of engagement pieces 562 and 563 is integrally molded by a raised portion 563*a* that is protruded so as to be approximately parallel to the raised portion 562*a* from slightly more on the locking stone attachment portion 29 side rather than the approximate center in the longitudinal direction of the arm 328, and a claw 563*b* that is bent and extended toward the base end side of the arm 328 from the tip of the raised portion 563*a*.

A long receiver 335 is formed along the straight line L1 by a pair of engagement pieces 562 and 563 described above and the arm 328. A slide plate 386 is fixed to the receiver 335 by snap-fitting. The length of the slide plate 386 in the direction of the straight line L1 is set so as to be slightly shorter than that of the length of the receiver 335 in the direction of the straight line L1. Thereby, the slide plate 386 can slidably move slightly in the receiver 335 along the direction of the straight line L1. In addition, after the position adjustment in the direction of the straight line L1 is performed, the slide plate is fixed to the receiver 335 by snap-fitting.

Here, in the arm 328, a convex portion 328*a* is formed at two places in the position corresponding to the receiver 335. By the convex portions 328*a*, the slide plate 386 is reliably snap-fitted to the snap fitting mechanism 560.

In addition, a convex portion 386*a*, which is protruded toward the side opposite to the escape wheel 2 from the position corresponding to between claws 562*b* and 563*b* of a pair of engagement pieces 562 and 563, is integrally molded to the slide plate 386.

On the other hand, a portion of the circular arc portion 331 of the one-side actuating spring 324 is extended and formed along the straight line L1 and toward the tip portion 30 of the blade 323. In addition, the terminal portion of the circular arc portion 331 is connected to the convex portion 386*a* of the slide plate 386.

According to the configuration, if the slide plate 386, which is fixed to the receiver 335 by snap-fitting, slidably moves, the one-side actuating spring 324 also becomes integral with the slide plate 386 and slidably moves along the straight line L1. That is, the tongue 32*c* of the one-side actuating spring 324 slidably moves toward the direction which is protruded from the tip portion 30. In other words, the tongue 32*c* slidably moves along the approaching and separating direction with respect to the balance 5.

Therefore, according to the ninth embodiment, effects similar to those of the seventh embodiment described above can be achieved. In addition to this, in the ninth embodiment, it is not necessary to perform the position adjustment of the tongue 32*c* while elastically deforming the one-side actuating spring 124 as the seventh embodiment. That is, the position adjustment of the tongue 32*c* of the one-side actuating spring 324 can be more smoothly performed with high accuracy.

Tenth Embodiment

Next, a tenth embodiment of the invention will be described with reference to FIG. 19.

Figure 19:
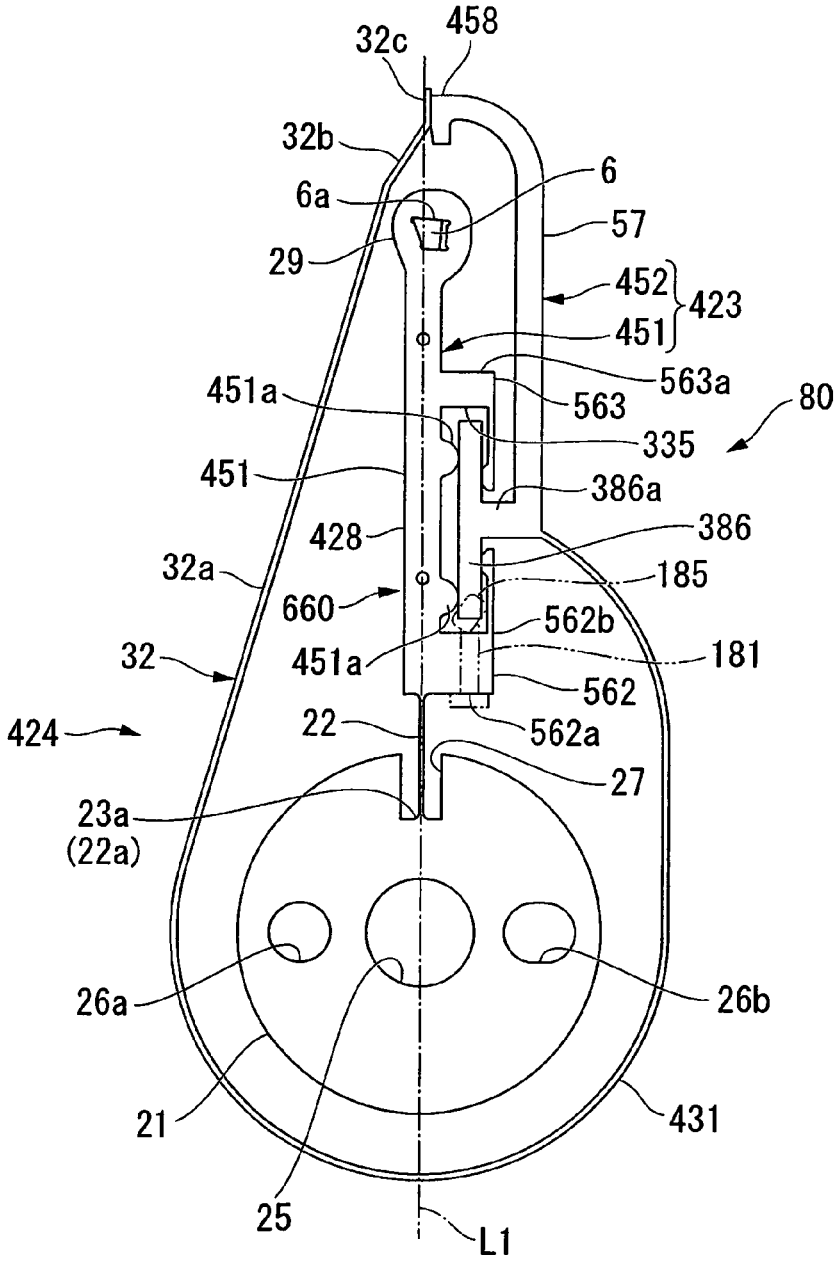
FIG. 19 is a plan view of a detent according to a tenth embodiment of the invention.

FIG. 19 is a plan view of the detent according to the tenth embodiment.

As shown in FIG. 19, the differences between the tenth embodiment and the first embodiment are as follows. That is, in the one-side actuating spring 24 of the detent 7 of the first embodiment, the terminal portion of the circular arc portion 31 of the one-side actuating spring 24 is connected to the base end of the arm 28. On the other hand, in the one-side actuating spring 424 of the detent 80 of the tenth embodiment, the terminal portion of the circular arc portion 431 is connected to the blade adjustment portion 452 of the blade 423.

More specifically, a snap fitting mechanism 660 for connecting the blade main body 451 and the blade adjustment portion 452 is integrally molded to the arm 428 which constitutes the blade main body 451 of the blade 423. The snap fitting mechanism 660 is constituted of a pair of engagement pieces 562 and 563 which are oppositely disposed along the longitudinal direction of the arm 428. In addition, a long receiver 335 is formed along the straight line L1 by a pair of engagement pieces 562 and 563 and the arm 428.

The slide plate 386 is fixed to the receiver 335 by snap-fitting. In addition, in the blade main body 451, a convex portion 451*a* is formed at two places in the position corresponding to the receiver 335. By the convex portions 451*a*, the slide plate 386 is reliably snap-fitted to the arm 428.

In addition, since the basic configurations of a pair of engagement pieces 562 and 563, the receiver 335, and the slide plate 386 are similar to those of the ninth embodiment described above, descriptions thereof are omitted.

Here, the base end of the blade adjustment portion 452 is connected to the convex portion 386*a* of the slide plate 386. In addition, the terminal portion of the circular arc portion 431 of the one-side actuating spring 424 is connected to the base end of the blade adjustment portion 452. That is, a portion of the circular arc portion 431 of the one-side actuating spring 424 is extended and formed along the straight line L1 and toward the base end of the blade adjustment portion 452. In addition, the terminal portion of the circular arc portion 431 is connected to the base end of the blade adjustment portion 452.

According to the configuration, if the slide plate 386, which is fixed to the receiver 335 by snap-fitting, slidably moves, the blade adjustment portion 452 and the one-side actuating spring 424 become integral to each other and slidably move. That is, the tip portion 458 of the blade adjustment portion 452 and the tongue 32*c* of the one-side actuating spring 424 become integral to each other, and slidably move along the approaching and separating direction with respect to the balance 5.

Thus, according to the tenth embodiment, in addition to the effects similar to those of the first embodiment, the position adjustment of the blade adjustment portion 452 and the one-side actuating spring 424 can be simultaneously performed while fixing the relative position relationship between the blade adjustment portion 452 and the one-side actuating spring 424. Thereby, more easily, the contact between the unlocking stone 4 and the blade adjustment portion 452 can be avoided while the unlocking stone 4 reliably contacts the one-side actuating spring 424.

In addition, in the ninth embodiment and the tenth embodiment described above, components similar to the position determination bolt 181 or the position adjustment cam 185 shown in the seventh embodiment described above may be installed in the snap fitting mechanisms 560 and 660 (refer to a dashed-two dotted line in FIGS. 18 and 19). Moreover, the position determination bolt 181 or the position adjustment cam 185 may function as a position determination mechanism for adjusting the attachment position of the slide plate 386.

In addition, the invention is not limited to the above-described embodiments. That is, the invention includes embodiments in which various modifications are added to the above-described embodiments within the scope without departing from the spirit of the invention.

For example, in the above-described embodiments, the case where the detents 7 and 72 to 80 are fixed to the main plate 102 via the angle adjustment mechanism 19 is described. However, the invention is not limited to this, and the detents 7 and 72 to 80 may be directly fixed to the main plate 102.

In addition, in the above-described embodiments, the case where the detents 7 and 72 to 80 are molded by the electroforming processing or the LIGA process is described. However, the invention is not limited to this, and the detents may be molded by resin. In addition, in the embodiments, it is described to be desirable that the balance spring 22 or the one-side actuating springs 24, 124, 224, 324, and 424 are formed of an elastic material such as nickel, phosphor bronze, stainless steel, Elinvar, coelinvar, or the like. However, the invention is not limited to this. For example, the balance spring or the one-side actuating spring may be constituted of a leaf spring or a wire spring which are made of metal.

In addition, in the case where the detent fixing portion 21 or the blades 23, 123, 223, 323, and 423 are molded by resin and the balance spring 22 or the one-side actuating springs 24, 124, 324, and 424 are constituted of the leaf spring or the wire spring, the balance spring 22 and the one-side actuating springs 24, 124, 324, and 424 may be insert-molded to the detent fixing portion 21 or the blades 23, 123, 223, 323, and 423.

In addition, in the above-described embodiments, the case where the blades 23, 123, 223, 323, and 423 are supported to the detent fixing portion 21 via the balance spring 22 is described. However, the invention is not limited to this. That is, as the so-called pivoted detent escapement, the blades 23, 123, 223, 323, and 423 may be rotatably supported via rotation axes (not shown), and therefore, the blades 23, 123, 223, 323, and 423 may approach to and separate from the escape wheel 2. In this case, a spiral spring (not shown) is installed so as to enclose the rotation axis (not shown) instead of the balance spring 22. In addition, it is desirable that the spiral spring biases the blades 23, 123, 223, 323, and 423 such that they are returned to the original positions.

In addition, in the above-described embodiments, the case where the center 21 of the detent fixing portion 21, the balance spring 22, the blades 23, 123, 223, 323, and 423, and the balance staff 9 all are formed at the base end 22*a* of the balance spring 22, that is, on the straight line L1 which connects the fulcrums 23*a* of the blades 23, 123, 223, 323, and 423 and the center of the balance staff 9 of the balance 5 is described. However, the invention is not limited to this. That is, the locking stone 6 of the blades 23, 123, 223, 323, and 423 may approach to and separate from the wheel tooth 2*a* of the escape wheel 2.

What is claimed is:

1. A detent escapement for a timepiece comprising:

an escape wheel;

a balance mounted for undergoing oscillation movement about a balance staff, the balance having an unlocking stone and having an impulse jewel for contacting a wheel tooth of the escape wheel;

a blade having a locking stone for contacting the wheel tooth of the escape wheel, the blade being supported for undergoing movement in approaching and separating directions relative to the escape wheel;

a one-side actuating spring for contacting the unlocking stone and for undergoing elastic deformation along the approaching and separating directions with respect to the blade; and an adjustment mechanism for adjusting a projecting amount of a spring tip portion of the one-side actuating spring from a blade tip portion of the blade.

2. The detent escapement of a timepiece according to claim 1, wherein the blade includes a blade main body having the locking stone and a blade adjustment portion having the blade tip portion, the blade adjustment portion being mounted for undergoing sliding movement along an axis crossing a rotational center of the escape wheel.

3. The detent escapement for a timepiece according to claim 1, wherein the blade has a blade main body and a blade adjustment portion that is separated from the blade main body and that includes at least the blade tip portion; and wherein the adjustment mechanism comprises the blade adjustment portion.

4. The detent escapement for a timepiece according to claim 3, wherein the blade main body and the blade adjustment portion are connected via a first snap fitting mechanism.

5. The detent escapement for a timepiece according to claim 3, further comprising a position determination mechanism for determining the position of the blade adjustment portion with respect to the blade main body.

6. The detent escapement for a timepiece according to claim 1, wherein the blade and the one-side actuating spring are formed so as to be separated from each other; and wherein the adjustment mechanism comprises at least one of the blade and the one-side actuating spring.

7. The detent escapement for a timepiece according to claim 6, wherein the one-side actuating spring is mounted so that at least the spring tip portion slidably moves along the approaching and separating directions with respect to the balance.

8. The detent escapement for a timepiece according to claim 6, wherein the blade and the one-side actuating spring are connected via a second snap fitting mechanism.

9. The detent escapement for a timepiece according to claim 6, further comprising a position determination mechanism for determining the position of the one-side actuating spring with respect to the blade.

10. The detent escapement for a timepiece according to claim 1, wherein the blade has a blade main body and a blade adjustment portion that is separated from the blade main body and that includes at least the blade tip portion, the blade and the one-side actuating spring arc being formed separately from each other, and the blade adjustment portion and the one-side actuating spring being integrally molded together; and wherein the adjustment mechanism comprises the blade adjustment portion and the one-side actuating spring.

11. The detent escapement for a timepiece according to claim 10, wherein at least the blade tip portion of the blade adjustment portion and the spring tip portion of the one-side actuating spring are mounted so as to be slidably moved along the approaching and separating directions with respect to the balance.

12. The detent escapement of a timepiece according to claim 1, further comprising:

a detent fixing portion for supporting the blade and the one-side actuating spring;

a washer for fixedly mounting the detent fixing portion to a main plate and and configured to undergo rotation relative to the main plate; and a rotating lever detachably mounted to the washer;

wherein the adjustment mechanism comprises the washer and the rotating lever.

13. A mechanical timepiece comprising:

a mainspring as a power source;

a gear train that is rotated by a rotational force generated when the mainspring is rewound; and the detent escapement according to claim 1 for controlling rotation of the gear train.

14. A mechanical timepiece comprising:

a mainspring as a power source;

a gear train that is rotated by a rotational force generated when the mainspring is rewound; and the detent escapement according to claim 3 for controlling rotation of the gear train.

15. A mechanical timepiece comprising:

a mainspring as a power source;

a gear train that is rotated by a rotational force generated when the mainspring is rewound; and the detent escapement according to claim 10 for controlling rotation of the gear train.

16. A detent escapement for a timepiece comprising:

an escape wheel mounted for undergoing rotational movement and having a plurality of wheel teeth;

a balance having an unlocking stone and having an impulse jewel for contacting one of the wheel teeth of the escape wheel to transmit a rotational force of the escape wheel to the balance;

a blade having a tip portion and having a locking stone for contacting one of the wheel teeth of the escape wheel;

an actuating spring having a tongue configured to be extended along the tip portion of the blade so that a tip of the tongue protrudes from the blade tip portion, the unlocking stone of the balance being configured to come into contact with a region of the tip of the tongue that protrudes from the blade tip portion; and an adjustment mechanism for adjusting a protruding amount of the tongue tip portion from the blade tip portion.

17. The detent escapement for a timepiece according to claim 16, wherein the blade includes a blade main body having the locking stone and a blade adjustment portion having the blade tip portion; and wherein the adjustment mechanism comprises the blade adjustment portion.

18. The detent escapement for a timepiece according to claim 16, wherein the actuating spring is configured to undergo elastic deformation toward and away from the blade; and wherein the adjustment mechanism comprises at least one of the blade and the actuating spring.

19. The detent escapement for a timepiece according to claim 16, wherein the blade includes a blade main body having the locking stone and a blade adjustment portion having the blade tip portion; wherein the blade adjustment portion and the actuating spring are integrally molded together; and wherein the adjustment mechanism comprises the blade adjustment portion and the actuating spring.

20. A mechanical timepiece comprising:

a mainspring as a power source;

a gear train that is rotated by a rotational force generated when the mainspring is rewound; and the detent escapement according to claim 16 for controlling rotation of the gear train.

* * * * *